US011463836B2

(12) United States Patent
Unno et al.

(10) Patent No.: US 11,463,836 B2
(45) Date of Patent: Oct. 4, 2022

(54) INFORMATION PROCESSING APPARATUS AND INFORMATION PROCESSING METHOD

(71) Applicant: SONY CORPORATION, Tokyo (JP)

(72) Inventors: Yukiko Unno, Tokyo (JP); Yoshiki Shudo, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 17/056,239

(22) PCT Filed: Apr. 10, 2019

(86) PCT No.: PCT/JP2019/015643
§ 371 (c)(1),
(2) Date: Nov. 17, 2020

(87) PCT Pub. No.: WO2019/225190
PCT Pub. Date: Nov. 28, 2019

(65) Prior Publication Data

US 2021/0219087 A1 Jul. 15, 2021

(30) Foreign Application Priority Data

May 22, 2018 (JP) ..... JP2018-097952

(51) Int. Cl.
*H04S 7/00* (2006.01)
*H04R 5/02* (2006.01)
(Continued)

(52) U.S. Cl.
CPC ..... *H04S 7/303* (2013.01); *H04R 5/02* (2013.01); *H04R 5/04* (2013.01); *H04S 3/008* (2013.01); *H04S 2400/01* (2013.01)

(58) Field of Classification Search
None
See application file for complete search history.

(56) References Cited

U.S. PATENT DOCUMENTS 6,574,339 B1 * 6/2003 Kim ..... H04S 3/00 381/17
2004/0151476 A1 8/2004 Suziki
(Continued)

FOREIGN PATENT DOCUMENTS

CN 1440629 A 9/2003
CN 104956695 A 9/2015
(Continued)

OTHER PUBLICATIONS

International Search Report and Written Opinion of PCT Application No. PCT/JP2019/015643, dated Jul. 2, 2019, 09 pages of ISRWO.

(Continued)

*Primary Examiner* — Qin Zhu
(74) *Attorney, Agent, or Firm* — Chip Law Group

(57) ABSTRACT

A user listening position is estimated without imposing a burden on a user, and a sound reproduction environment suitable for listening is formed regardless of an actual speaker arrangement state. An estimation part that estimates the user listening position by using position information of N speakers that are three or more speakers, and an arrangement part that sets virtual speaker arrangement by using the user listening position are provided. Therefore, it is possible to estimate the user listening position without imposing a burden on a user and form a sound reproduction environment suitable for listening regardless of an actual speaker arrangement state.

18 Claims, 15 Drawing Sheets

(51) Int. Cl.
*H04R 5/04* (2006.01)
*H04S 3/00* (2006.01)

(56) References Cited

U.S. PATENT DOCUMENTS

| | | | | |
|---|---|---|---|---|
| 2004/0228498 | A1* | 11/2004 | Sekine | H04S 7/30 381/303 |
| 2005/0220309 | A1 | 10/2005 | Hirata et al. | |
| 2009/0136048 | A1 | 5/2009 | Yoo et al. | |
| 2012/0114137 | A1 | 5/2012 | Tsurumi | |
| 2014/0219455 | A1 | 8/2014 | Peters et al. | |
| 2015/0016642 | A1 | 1/2015 | Walsh et al. | |
| 2016/0029144 | A1* | 1/2016 | Cartwright | H04S 7/304 381/310 |
| 2020/0112815 | A1* | 4/2020 | Audfray | H04R 5/033 |

FOREIGN PATENT DOCUMENTS

| | | | |
|---|---|---|---|
| CN | 106255031 | A | 12/2016 |
| EP | 1443804 | A1 | 8/2004 |
| EP | 2954702 | A1 | 12/2015 |
| JP | 11-331999 | A | 11/1999 |
| JP | 2000-059898 | A | 2/2000 |
| JP | 2004-241820 | A | 8/2004 |
| JP | 2015-122612 | A | 7/2015 |
| JP | 2016-509820 | A | 3/2016 |
| KR | 10-2015-0115822 | A | 10/2015 |
| WO | 2006/131894 | A2 | 12/2006 |
| WO | 2013/183392 | A1 | 12/2013 |
| WO | 2014/124264 | A1 | 8/2014 |
| WO | 2014/124268 | A1 | 8/2014 |
| WO | 2015/009748 | A1 | 1/2015 |

OTHER PUBLICATIONS

Bosun, et al., "Virtual reproducing system for 5.1 channel surround sound", Applzed Physzcs Dept., South Chzna Unzversztyof Technology Guangzhou 510641, 2 Telecommunzcatzon College, BezJzng Unzverszty of Posts and Telecommunzcatzons Beijing 100876, Jun. 30, 2005, pp. 1-19.

Office Action for CN Patent Application No. 201980032496.1, dated Dec. 23, 2021, 12 pages of English Translation and 06 pages of Office Action.

* cited by examiner

INFORMATION PROCESSING APPARATUS AND INFORMATION PROCESSING METHOD

CROSS REFERENCE TO RELATED APPLICATIONS

This application is a U.S. National Phase of International Patent Application No. PCT/JP2019/015643 filed on Apr. 10, 2019, which claims priority benefit of Japanese Patent Application No. JP 2018-097952 filed in the Japan Patent Office on May 22, 2018. Each of the above-referenced applications is hereby incorporated herein by reference in its entirety.

TECHNICAL FIELD

The present technology relates to an information processing apparatus, an information processing method, and a program, and particularly to a technology of a surround sound system.

BACKGROUND ART

In a surround sound system in which a plurality of speakers can be connected, sound field correction is performed in order to obtain a sound field suitable for listening by a user in some cases. When performing conventional sound field correction, a user listening position is detected by allowing the user at a listening position to perform operation indicating own listening position, such as by having a measuring instrument such as a microphone.

CITATION LIST

Patent Document

Patent Document 1: Japanese Patent Application Laid-Open No. 11-331999

SUMMARY OF THE INVENTION

Problems to be Solved by the Invention

Patent Document 1 discloses a method in which a speaker emits an ultrasonic signal, a remote controller at a listening position receives the signal from each speaker, and a distance ratio from each speaker to the remote controller (listening position) is calculated using a phase difference of the detected signals. In this case, a user needs to hold the remote controller and wait at the listening position, so that there is a possibility that the behavior of the user is limited during measurement of the listening position. Furthermore, a measuring instrument is included as a part of a speaker system in addition to devices such as a speaker, which complicates the product configuration.

Furthermore, surround sound systems exhibit a surround effect by arrangement of a speaker at an appropriate angle from a user listening position. However, depending on the environment in which the speaker system is used, the speakers cannot be arranged appropriately in some cases due to, for example, the shape and size of the room and the arrangement of furniture or the like. Therefore, there is a possibility that the surround effect of the surround sound system is not sufficiently exerted in some cases.

Therefore, the present technology has an object to, in a case of arranging a plurality of speakers such as in a surround sound system, estimate a user listening position without imposing a burden on a user and form a sound reproduction environment suitable for listening regardless of an actual speaker arrangement environment.

Solutions to Problems

An information processing apparatus according to the present technology includes: an estimation part that estimates a user listening position by using position information of N speakers that are three or more speakers; and an arrangement part that sets virtual speaker arrangement by using the user listening position.

In the present technology as described above, a virtual speaker, which is a speaker virtually arranged at a position different from an actual speaker arrangement, is assumed. The user listening position is estimated on the basis of position information of the N speakers. Furthermore, virtual speaker arrangement is set on the basis of the estimated user listening position.

In the information processing apparatus according to the present technology described above, it is conceivable that the arrangement part sets an arrangement circle centered on the user listening position and sets the virtual speaker arrangement so that the virtual speaker is arranged on a circumference of the arrangement circle.

The arrangement part sets the virtual speaker arrangement on the circumference of the arrangement circle centered on the user listening position.

In the information processing apparatus according to the present technology described above, it is conceivable that the estimation part recognizes a standard speaker, among the N speakers, and a farthermost speaker that is located farthermost from a reference position determined according to the standard speaker, and performs processing of obtaining a standard circle passing through the standard speaker and the farthermost speaker and processing of moving a center of the standard circle on the basis of position information of the N speakers to estimate the center of the standard circle after being moved as the user listening position.

A standard circle as large as possible is obtained using the standard speaker and the farthermost speaker. By moving the center of the standard circle on the basis of the position information of the N speakers, the user listening position that reflects an actual arrangement situation of the N speakers is estimated.

In the information processing apparatus according to the present technology described above, it is conceivable that the arrangement part performs processing of enlarging a radius of the standard circle by predetermined constant multiplication.

By enlarging the radius of the standard circle by predetermined constant multiplication, a radius having a size obtained by enlarging the radius by predetermined constant multiplication is calculated.

In the information processing apparatus according to the present technology described above, it is conceivable that a front left speaker and a front right speaker are the standard speakers, and the reference position is a midpoint between the front left speaker and the front right speaker.

By using the front left speaker and the front right speaker as the standard speakers, the user listening position in the left and right direction is estimated on the basis of the midpoint of the front left speaker and the front right speaker.

In the information processing apparatus according to the present technology described above, it is conceivable that a front center speaker is the standard speaker, and the reference position is a position where the front center speaker is arranged.

By using the front center speaker as the standard speaker, the user listening position in the left and right direction is estimated on the basis of the front center speaker arranged in front of the actual user listening position.

In the information processing apparatus according to the present technology described above, it is conceivable that the estimation part obtains an average position in at least the front and back direction of the N speakers using the position information of the N speakers, and moves the center of the standard circle in the front and back direction up to a position aligned with the average position in the left and right direction.

The average position in at least the front and back direction of the N speakers is obtained, and the standard point, which is the center of the standard circle, is moved in the front and back direction up to a position aligned with the average position in the left and right direction. Therefore, the center position of the standard circle after being moved is obtained.

In the information processing apparatus according to the present technology described above, it is conceivable that in a case where the radius of the arrangement circle is larger than a predetermined length and the virtual speaker arranged on a circumference of the arrangement circle is posterior to any of the speakers, the arrangement part sets the radius of the arrangement circle to the radius of the predetermined length and resets virtual speaker arrangement.

After setting the virtual speaker arrangement on the circumference of the arrangement circle, the radius of the arrangement circle is set to a radius of a predetermined length, and the virtual speaker arrangement is reset to the new arrangement circle having the radius of the predetermined length.

In the information processing apparatus according to the present technology described above, it is conceivable that, in a case where the N speakers are located within a predetermined range in the front and back direction, the estimation part estimates the user listening position by using the position information of the standard speaker and the position information of the average position in the front and back direction of the N speakers, and the arrangement part sets the radius of the arrangement circle to the predetermined length.

In a case where the N speakers are located within a predetermined range in the front and back direction, the user listening position is estimated by using the position information of the standard speaker and the position information of the average position of the N speakers in the front and back direction, and the arrangement circle of a predetermined radius is set around the user listening position estimated as described above.

In the information processing method according to the present technology, the information processing apparatus estimates a user listening position by using position information of N speakers that are three or more speakers; and sets virtual speaker arrangement by using the user listening position.

In the information processing apparatus, an information processing apparatus is provided to perform the processing of the above step.

A program according to the present technology is a program that causes an information processing apparatus to perform the processing as described above. Accordingly, the information processing method of the present technology is achieved in an information processing apparatus including an information processing apparatus.

Effects of the Invention

According to the present technology, it is possible to estimate a user listening position without imposing a burden on a user, and to form a sound reproduction environment suitable for listening regardless of a speaker arrangement state.

Note that the effects described herein are not necessarily limited, and any of the effects described in the present disclosure may be applied.

MODE FOR CARRYING OUT THE INVENTION

Hereinafter, embodiments will be described in the following order.

<1. Speaker system configuration>

<2. Speaker position information acquisition and channel setting>

<3. User listening position estimation and virtual speaker arrangement setting>

<4. Processing example>

<5. Summary and modification>

<1. Speaker System Configuration>

In an embodiment, a surround sound system capable of connecting three or more speakers is assumed, and the user listening position is estimated and the virtual speaker arrangement is set.

Figure 1:
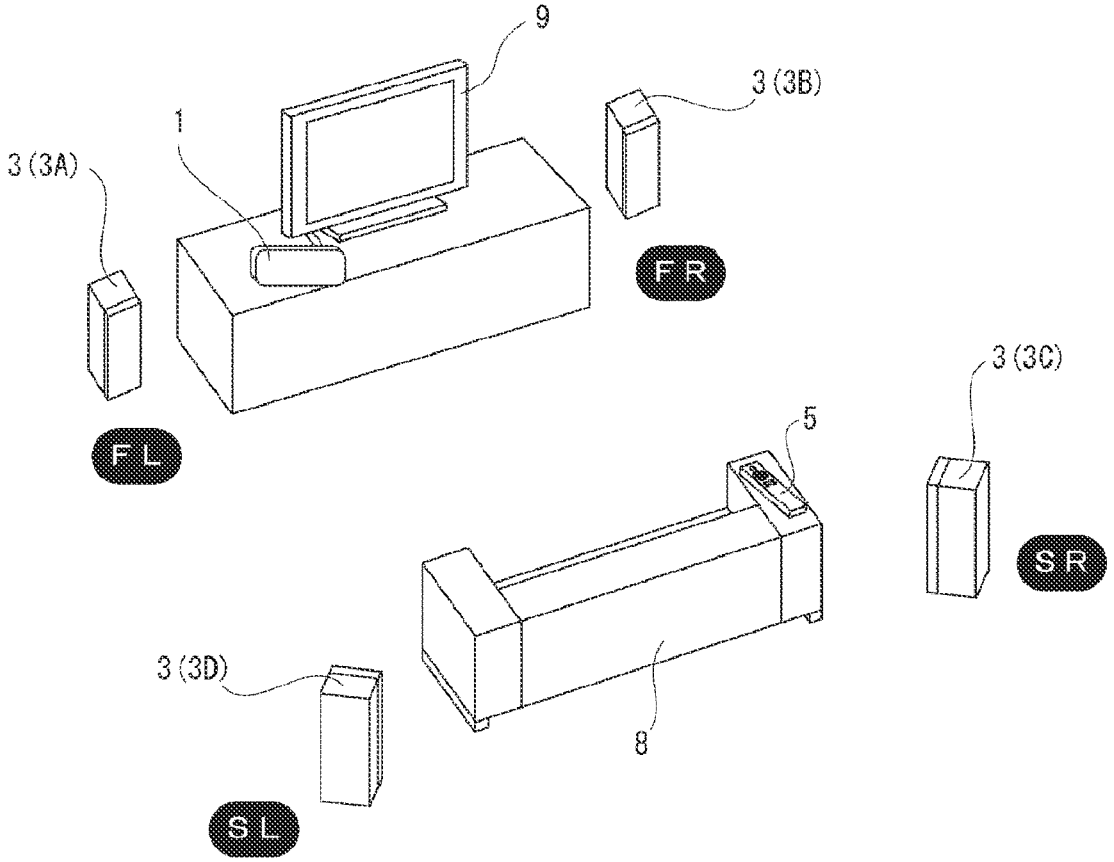
FIG. 1 is an explanatory diagram of an arrangement example of a speaker system according to an embodiment of the present technology.

Hereinafter, as shown in FIG. 1, a surround sound system using four speakers 3 (3A, 3B, 3C, and 3D) will be described as an example.

Note that, in a case where the four speakers are collectively referred to or are not particularly distinguished from each other, the speakers are referred to as "speaker 3". In a case of referring to individual speakers, the speakers are described as "speaker 3A" to "speaker 3D".

As channels of the speaker 3, four channels are assumed, and are a front L channel, a front R channel, a surround L channel, and a surround R channel. These are referred to as "FL channel", "FR channel", "SL channel", and "SR channel".

Of course, using four channels is an example for description, and a case of 5 channels, 5.1 channels, 7 channels, 7.1 channels, or the like is also conceivable.

In order to distinguish the channels set for each speaker, the front left front L channel speaker is referred to as "FL speaker", the front right front R channel speaker is referred to as "FR speaker", the rear left surround L channel speaker is referred to as "SL speaker", and the rear right surround R channel speaker is referred to as "SR speaker".

For example, in a case where the speaker 3A is set to the front L channel, the speaker 3A is referred to as "FL speaker 3A" in some cases.

FIG. 1 shows an arrangement example of a surround sound system in a living room, for example.

The surround sound system of the embodiment is configured as a speaker system including an information processing apparatus 1 and speakers 3A, 3B, 3C, and 3D. Furthermore, the speaker system includes a remote controller 5 in some cases.

Furthermore, the speaker system is used, for example, for sound reproduction of video content displayed on a monitor device 9 as a television receiver or the like, or even in a case where video display is not performed on the monitor device 9, the speaker system is used for reproduction of audio such as music or environmental sound.

The monitor device 9 is arranged at a position on the front side of a user, for example, in front of a sofa 8. Then, in this example, the information processing apparatus 1 is arranged near the monitor device 9. Normally, a direction in which the user faces the monitor device 9 is the front.

The FL speaker 3A is arranged on the left side of the monitor device 9, and the FR speaker 3B is arranged on the right side of the monitor device 9.

The SL speaker 3C is arranged on the rear left side of the sofa 8 and the SR speaker 3D is arranged on the rear right side of the sofa 8.

The above arrangement is a typical arrangement example of the monitor device 9 and the four-channel speaker system. Of course, the actual arrangement varies according to the user's preference, furniture arrangement, room size, room shape and the like. However, basically, it is preferable that the speakers 3A, 3B, 3C, and 3D are arranged in positions suitable as FL channel, FR channel, SL channel, and SR channel.

Figure 2:
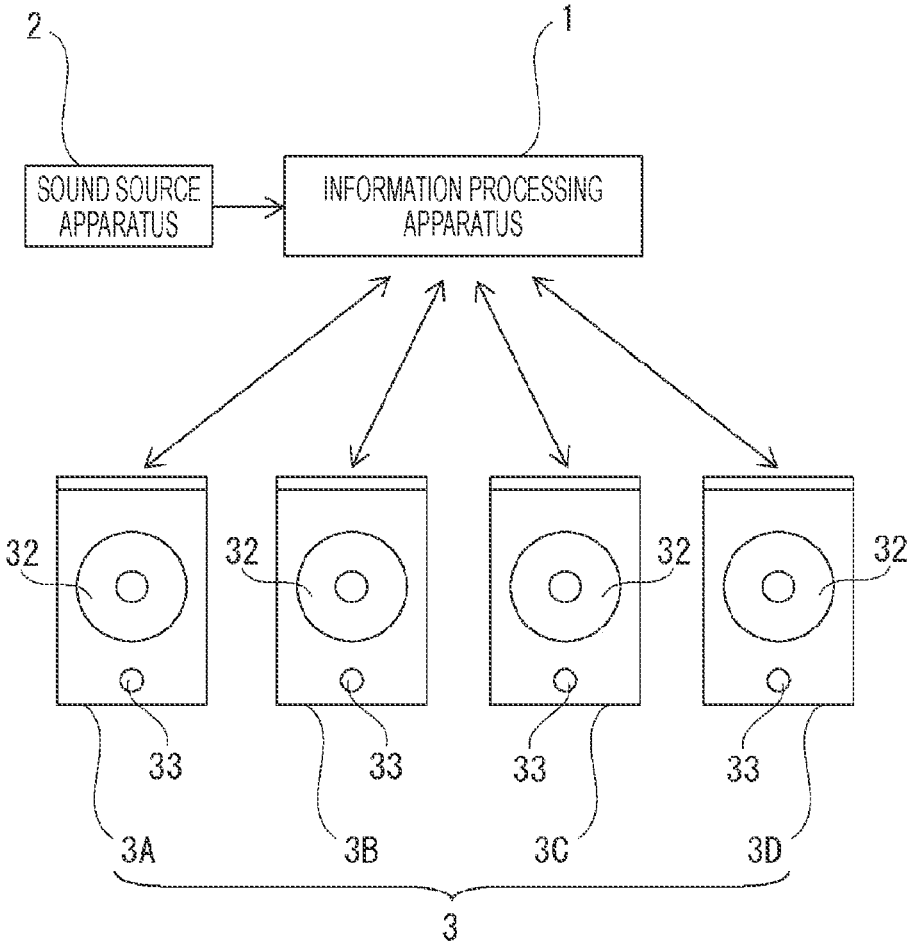
FIG. 2 is an explanatory diagram of a device configuration of the speaker system of the embodiment.

FIG. 2 shows a configuration example of the speaker system of the embodiment.

In the speaker system, the information processing apparatus 1 as a master device and the speakers 3A, 3B, 3C, and 3D as slave devices can communicate with each other.

Note that communication between the information processing apparatus 1 and each speaker 3 may be wireless communication by a communication method such as Wi-Fi (registered trademark) or Bluetooth (registered trademark), or may be connection by wire so that local area network (LAN) communication, universal serial bus (USB) communication, or the like is performed, for example. Of course, the information processing apparatus 1 and each speaker 3 may be connected by a dedicated line including an audio line and a control line.

Sound signals (digital sound signals or analog sound signals), control data, notification data, and the like are transmitted between the information processing apparatus 1 and the speaker 3 by the wireless or wired communication. Furthermore, the speakers 3A, 3B, 3C, and 3D are time-synchronized via the information processing apparatus 1, for example.

The speakers 3A, 3B, 3C, and 3D may be communicable with each other, or may be configured not to communicate with each other.

The channels of the speakers 3A, 3B, 3C, and 3D are set (channel assigned) by the information processing apparatus 1.

Although the speakers 3A, 3B, 3C, and 3D have, for example, individual speaker IDs as identifiers, the speakers basically have the same configuration and are not dedicated devices for a certain channel. For example, the speaker 3A can be used as any of the FL speaker, the FR speaker, the SL speaker, and the SR speaker. This is similar for the other speakers 3B, 3C, and 3D.

Therefore, the user is only required to arrange the speakers 3A, 3B, 3C, and 3D without being aware of the distinction between them, for example, as shown in FIG. 1.

The channels of the speakers 3 are assigned by the information processing apparatus 1, so that the channels are decided from the viewpoint of the information processing apparatus 1.

The information processing apparatus 1 receives a sound signal input from a sound source apparatus 2, performs necessary signal processing, and transmits the sound signal distributed to each channel to the speaker 3 to which the signal is assigned. Each speaker 3 receives the sound signal of the corresponding channel from the information processing apparatus 1 and outputs sound. As a result, four-channel surround sound output is performed.

The sound source apparatus 2 shown in FIG. 2 may be, for example, the monitor device 9, a reproduction device (audio player) that is not shown, or the like.

The sound source apparatus 2 supplies to the information processing apparatus 1 sound signals (digital sound signals or analog sound signals) of L and R stereo channels and sound signals compatible with multi-channel surround.

The information processing apparatus 1 distributes or generates sound signals of channels compatible with the installed speakers 3, and in a case of this example, generates sound signals of the FL channel, the FR channel, the SL channel, and the SR channel, and transmits the generated signals to the speakers 3A, 3B, 3C, and 3D.

Each speaker 3 includes a speaker unit 32, and the speaker unit 32 is driven by the transmitted sound signal to output sound.

Note that each speaker 3 has a microphone 33 that can be used for channel setting as described later.

Figure 3:
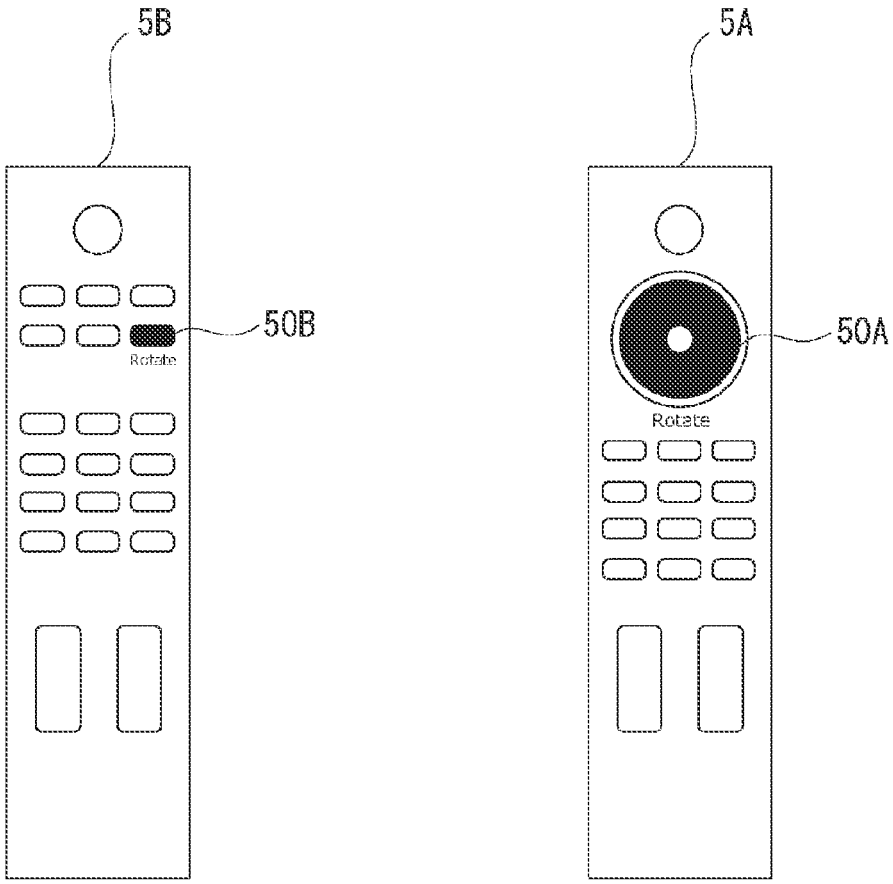
FIG. 3 is an explanatory diagram of a remote controller used in the speaker system of the embodiment.

FIG. 3 shows remote controllers 5A, 5B as an example of the remote controller 5. The remote controllers 5A, 5B transmit user operation information to the information processing apparatus 1 by infrared rays or radio waves, for example.

Figure 4:
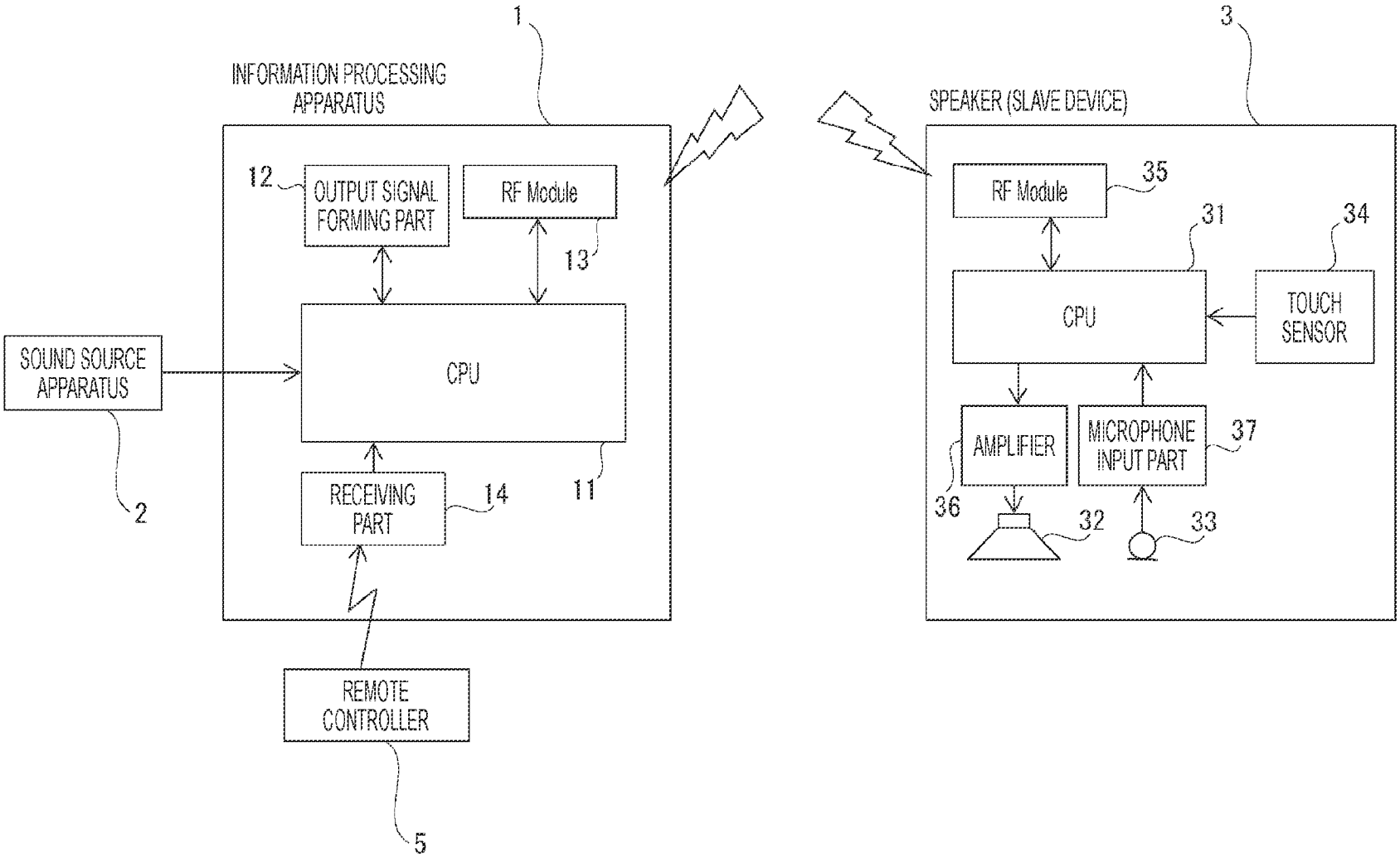
FIG. 4 is a block diagram of an internal configuration of the information processing apparatus and speakers of the embodiment.

The internal configurations of the information processing apparatus 1 and the speaker 3 will be described with reference to FIG. 4. Note that, in the description below, it is assumed that wireless communication is performed between the information processing apparatus 1 and the speaker 3.

In wireless communication, each speaker 3, which is a slave device, can identify communication addressed to itself by a slave address given to its own speaker.

Furthermore, each speaker 3 causes its own identifier (speaker ID) to be included in the transmission information so that the information processing apparatus 1 can identify which speaker the communication is from.

The information processing apparatus 1 includes a central processing unit (CPU) 11, an output signal forming part 12, a radio frequency (RF) module 13, and a receiving part 14.

The output signal forming part 12 performs processing related to a sound signal output to each speaker 3. For example, the output signal forming part 12 cooperates with the CPU 11 to perform distribution of sound signals for each channel or generation processing of a channel sound signal, and generation processing of a sound signal to each speaker for virtual speaker output as described later, for example, signal processing including channel mixing, localization adjustment, delaying or the like. Furthermore, the output signal forming part 12 also performs amplification processing, sound quality processing, equalizing, band-pass filter processing, and the like on the sound signal of each channel.

Furthermore, the output signal forming part 12 also performs processing of generating a sound signal as a test tone used when setting a channel, in some cases.

The RF module 13 transmits a sound signal and a control signal to each speaker 3, and receives a signal from each speaker 3.

Therefore, the RF module 13 performs encoding processing and transmission processing for wireless transmission of a sound signal and a control signal to be transmitted that has been supplied from the CPU 11. Furthermore, the RF module 13 performs reception processing of a signal transmitted from the speaker 3, decoding processing of received data, transferring the result to the CPU 11, and the like.

The receiving part 14 receives an operation signal from the remote controller 5, demodulates/decodes the received operation signal, and transmits operation information to the CPU 11.

The CPU 11 performs operation processing on the sound signal supplied from the sound source apparatus 2, channel setting processing, processing regarding virtual speakers, and the like.

Figure 5:
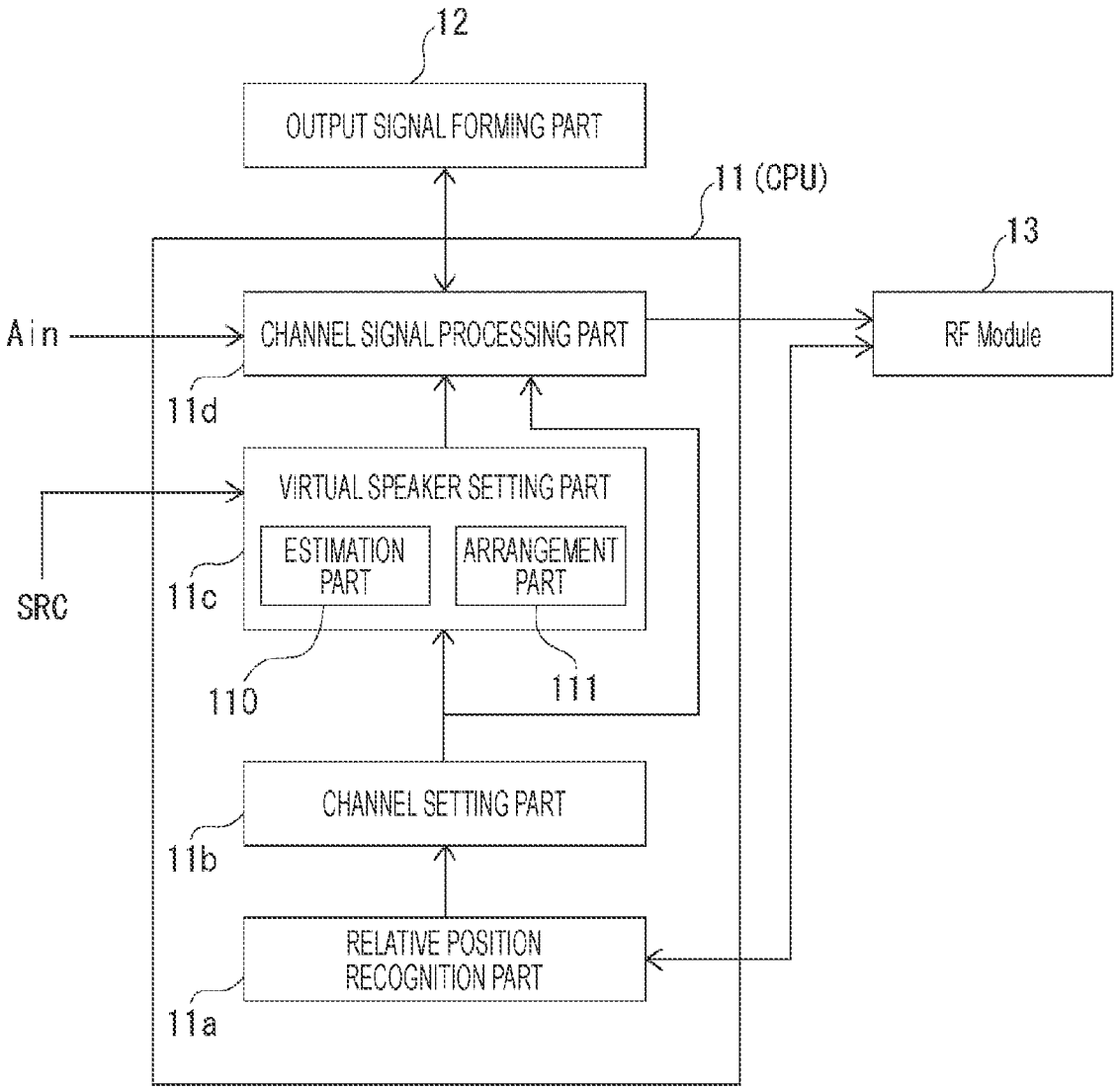
FIG. 5 is an explanatory diagram of a functional configuration of the information processing apparatus of the embodiment.

In a case of the present embodiment, the CPU 11 is provided with functions shown in FIG. 5 by an installed program (software), and operation processing as these functions is performed. That is, the CPU 11 has functions as a relative position recognition part 11*a*, a channel setting part 11*b*, a virtual speaker setting part 11*c*, and a channel signal processing part 11*d*.

The relative position recognition part 11*a* and the channel setting part 11*b* perform processing for setting the channel of each speaker 3.

The relative position recognition part 11*a* receives a notification that a user has made a designation operation from two of the N (four in this example) speakers 3 that have been installed, and performs processing of recognizing the two arrangement standard speakers. Furthermore, the relative position recognition part 11*a* performs processing of acquiring distance information between the speakers 3. Moreover, the relative position recognition part 11*a* performs processing of recognizing a relative positional relationship between the N (four) speakers 3 using the two arrangement standard speakers and information on distances among the speakers.

The channel setting part 11*b* performs processing of automatically setting the channel of each speaker 3 on the basis of the relative positional relationship recognized by the relative position recognition part 11*a*.

The virtual speaker setting part 11*c* performs processing of setting the virtual speaker arrangement on the basis of the relative positional relationship recognized by the relative position recognition part 11*a* and the channel setting by the channel setting part 11*b*. The virtual speaker is a speaker virtually arranged at a position different from an actual arrangement of the speaker 3. Setting a virtual speaker by the virtual speaker setting part 11*c* means that predetermined processing is performed on the sound signal for each speaker 3 to perform sound output in a position different from the actual arrangement of the speaker 3 and in a localized state.

The virtual speaker setting part 11*c* has functions as an estimation part 110 that estimates the user listening position and an arrangement part 111 that sets virtual speaker arrangement by using the user listening position, and sets the virtual speaker arrangement on the basis of the estimated user listening position. Specific processing by each function as the virtual speaker setting part 11*c* will be described later.

The channel signal processing part 11*d* generates, in cooperation with the signal processing in the output signal forming part 12, an N-channel audio signal to be supplied to each of the N speakers 3 with respect to the input sound signal, and performs processing of transferring the result to the RF module 13.

Furthermore, in a case where the virtual speaker arrangement setting is performed by the virtual speaker setting part 11*c*, the channel signal processing part 11*d* performs processing of generating, as a transmission signal to each speaker 3, an N-channel sound signal that has been processed to be in a localized state which achieves a virtual speaker, in cooperation with the output signal forming part 12.

Returning to FIG. 4, the configuration of the speaker 3 will be described.

The speaker 3 includes a CPU 31, a speaker unit 32, a microphone 33, a touch sensor 34, an RF module 35, an amplifier 36, and a microphone input part 37.

The CPU 31 performs communication processing and speaker inside control.

The RF module 35 is a module that performs wireless communication with the RF module 13 of the information processing apparatus 1. The RF module 35 receives a sound signal or a control signal transmitted from the information processing apparatus 1, performs decoding processing of the signal, and transfers the decoded signal to the CPU 31.

The RF module 35 also performs processing of encoding a control signal or a notification signal transferred from the CPU 31 for wireless transmission and transmitting the signal to the information processing apparatus 1.

The CPU 31 supplies the sound signal transmitted from the information processing apparatus 1 to the amplifier 36.

The amplifier 36 converts, for example, a sound signal as digital data transferred from the CPU 31 into an analog signal, amplifies the converted signal, and outputs the result to the speaker unit 32. As a result, sound output is performed from the speaker unit 32.

Note that, in a case where the speaker unit 32 is directly driven by digital sound data, the amplifier 36 is only required to output a digital sound signal.

External sound is collected by the microphone 33. The sound signal obtained by the microphone 33 is amplified by the microphone input part 37, converted into, for example, digital sound data and supplied to the CPU 31.

The CPU 31 can store a microphone input sound signal together with time information (time stamp) in an internal random access memory (RAM), for example. Alternatively, the CPU 31 may store only the time information without storing the sound signal in a case where a specific sound signal as a test sound as described later is detected.

The CPU 31 transfers the stored information to the RF module 35 at a predetermined timing and causes the information processing apparatus 1 to transmit the information.

The touch sensor 34 is a contact detection sensor formed as a touch pad or the like at a position easily touched by the user, such as the upper surface or front surface of the housing of the speaker 3, for example.

The touch sensor 34 detects user's touch operation, and detection information is transmitted to the CPU 31.

In a case where touch operation is detected, the CPU 31 causes the RF module 35 to transmit touch operation detection information to the information processing apparatus 1.

Note that the touch sensor 34 is an example of a device that detects user operation on the speaker 3. Instead of the touch sensor 34 or in addition to the touch sensor 34, a device such as an imaging device (camera), an operation button, or a capacitance sensor that can detect the user's operation or behavior may be provided.

Furthermore, an example is conceivable in which the touch sensor 34 or the like is not provided, and sound (contact sound) associated with touch operation is detected by the microphone 33.

<2. Speaker Position Information Acquisition and Channel Setting>

Channel setting of the present embodiment performed in the above configuration will be described.

Note that, for simplification of description, it is assumed that the speakers 3 are arranged on the same plane.

In a case where the user manually sets the speaker output channel when setting up the speaker system, the setting may be erroneous. Furthermore, some users may not understand the channel setting work or may find it troublesome. In such a state, correct surround sound cannot be reproduced.

In the present embodiment, the user can set the output channels of all the speakers 3 correctly by simply touching some of the speakers 3.

Channel setting step will be described with reference to FIGS. 6A, 6B, 7A, 7B, 8A, 8B, 9A, and 9B.

Figure 6A:
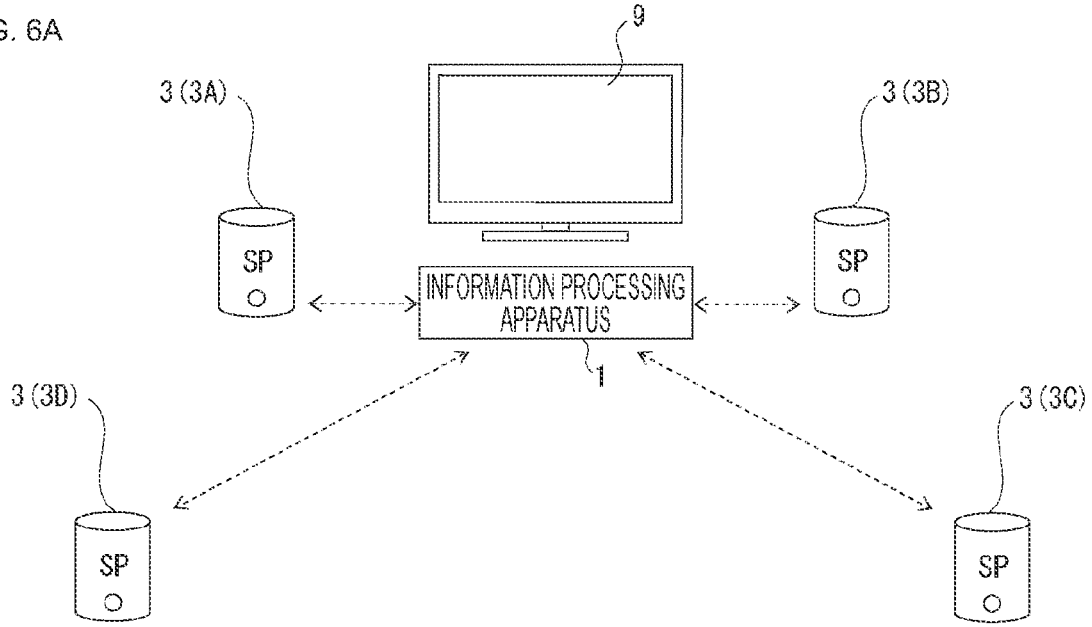
FIGS. 6A and 6B are explanatory diagrams of a channel setting step according to the embodiment.

FIG. 6A shows a state in which the information processing apparatus 1 and the four speakers 3A, 3B, 3C, and 3D are installed as described in FIG. 1, for example.

In the speaker system of the present embodiment, since the channel setting of each speaker 3 is not predetermined, the user installs each of the speakers 3A, 3B, 3C, and 3D at any position without worrying about the channel setting. Naturally, the channels of the speakers 3 have not been set yet.

In this state, when the power of the information processing apparatus 1 which is the parent device and each speaker 3 is turned on, as shown in the drawing, the information processing apparatus 1 and each speaker 3 are wirelessly connected by, for example, WiFi, so that an initial setup is started.

Figure 6B:
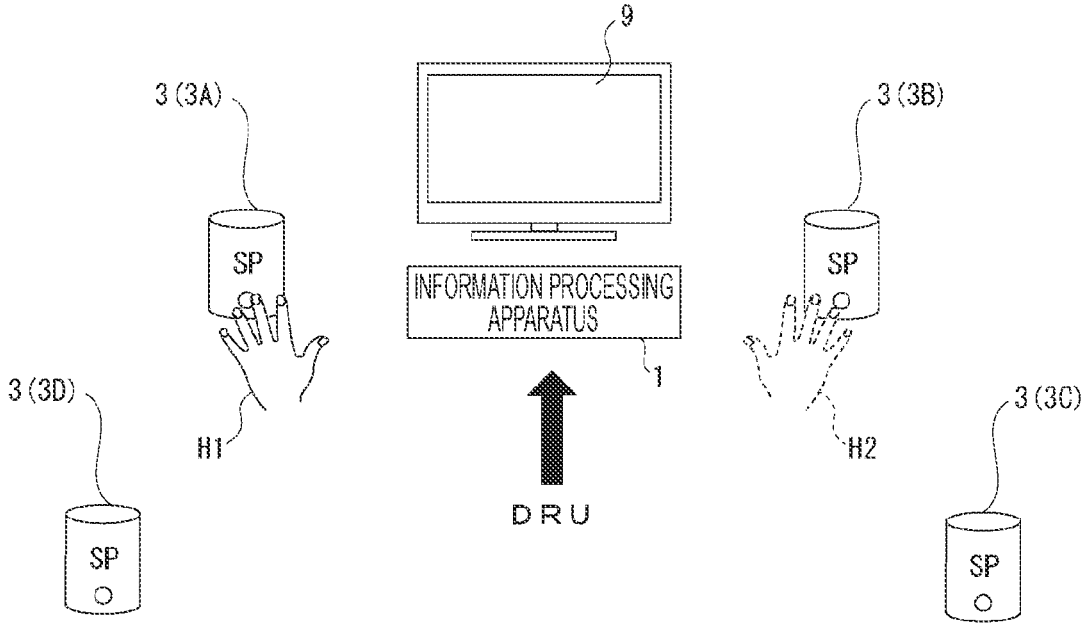

When the initial setup is started, the user follows the guidance of the speaker system, touches the speaker 3A placed on the left side of the monitor device 9 as shown by the solid line H1 in FIG. 6B, and subsequently, touches the speaker 3B placed on the right side of the monitor device 9 as shown by the broken line H2.

For example, the speaker system may play guidance sound such as "Please touch the left speaker in the front" as guidance, or display the message on the monitor device 9.

In response to this, the user performs operation of touching the touch sensor 34 of left speaker 3A in the front (arrow DRU). Normally, a direction in which the user faces the monitor device 9 is the front.

When it is detected that the user has performed operation of touching the touch sensor 34 of the speaker 3A, for example, the speaker system subsequently provides guidance of "Please touch the right speaker in the front".

In response to this, the user subsequently performs operation of touching the touch sensor 34 of the speaker 3B.

Note that a user who does not use the monitor device 9 is also assumed. Such a user is only required to touch the front left speaker and the front right speaker in order in accordance with the position and direction in which the user normally listens.

Figure 7A:
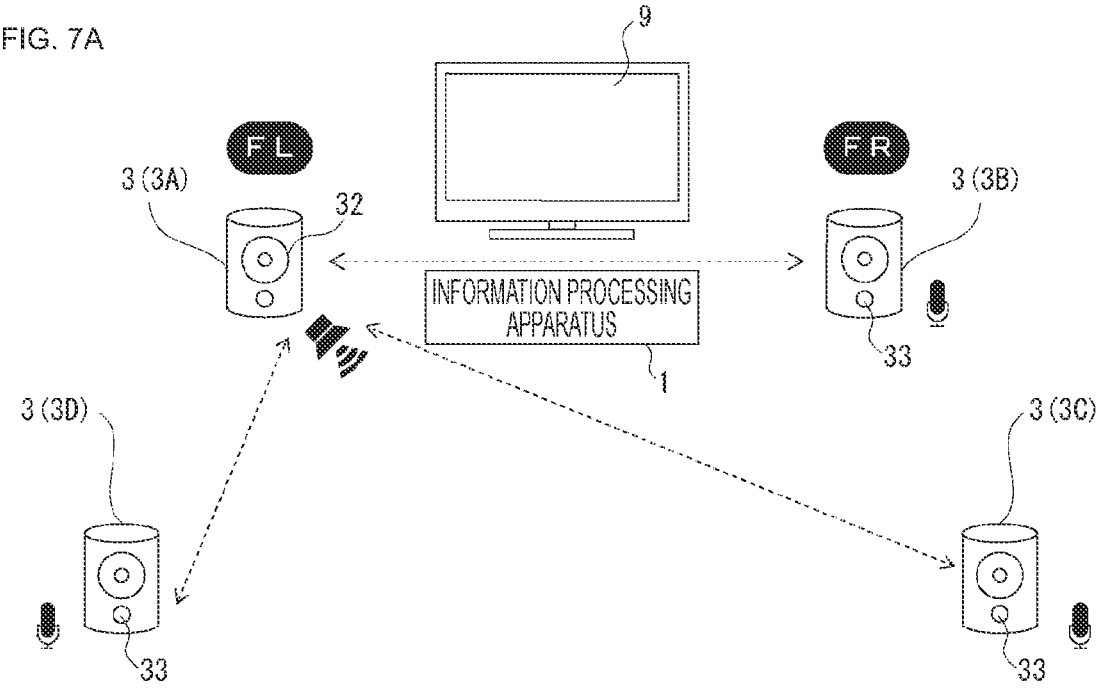
FIGS. 7A and 7B are explanatory diagrams of a channel setting step according to the embodiment.

When the user touches the two speakers 3A and 3B in order as described above, the speaker system sets the speakers 3A and 3B as the FL speaker and the FR speaker. FIG. 7A shows a state where the speakers 3A and 3B are set to the FL speaker and the FR speaker.

Up to this point, the speaker system can identify the FL speaker 3A and the FR speaker 3B, and can estimate the listening direction of the user as a relative positional relationship with respect to the set FL speaker 3A and the FR speaker 3B.

Subsequently, the speaker system automatically measures the distance between the speakers 3. It is assumed that the information processing apparatus 1 which is a master device and each speaker 3 are time-synchronized by using a precision time protocol (PTP) method or the like.

The distance between the speakers 3 is measured by detecting the test sound reproduced by one speaker 3 by another speaker 3 and measuring the arrival time.

For example, as shown in FIG. 7A, the test sound reproduced by the speaker unit 32 of the FL speaker 3A is collected by the microphones 33 mounted on the FR speakers 3B, speakers 3C, 3D and stored together with a time stamp (time information).

In this case, from the difference between the reproduction time information of the reproduction side speaker 3A and the stored time information of each of the other speakers 3B, 3C, 3D, distance between the speakers 3A and 3B, distance between the speakers 3A and 3C, and distance between the speakers 3A and 3D can be measured.

The test sound is only required to be output for a moment, for example, as an electronic sound of a predetermined frequency or the like. Of course, it may be continuous sound such as one second or several seconds. In any case, any sound may be used as long as the arrival time can be measured.

Such operation is performed by changing the speaker 3 to be used for reproducing.

Figure 7B:
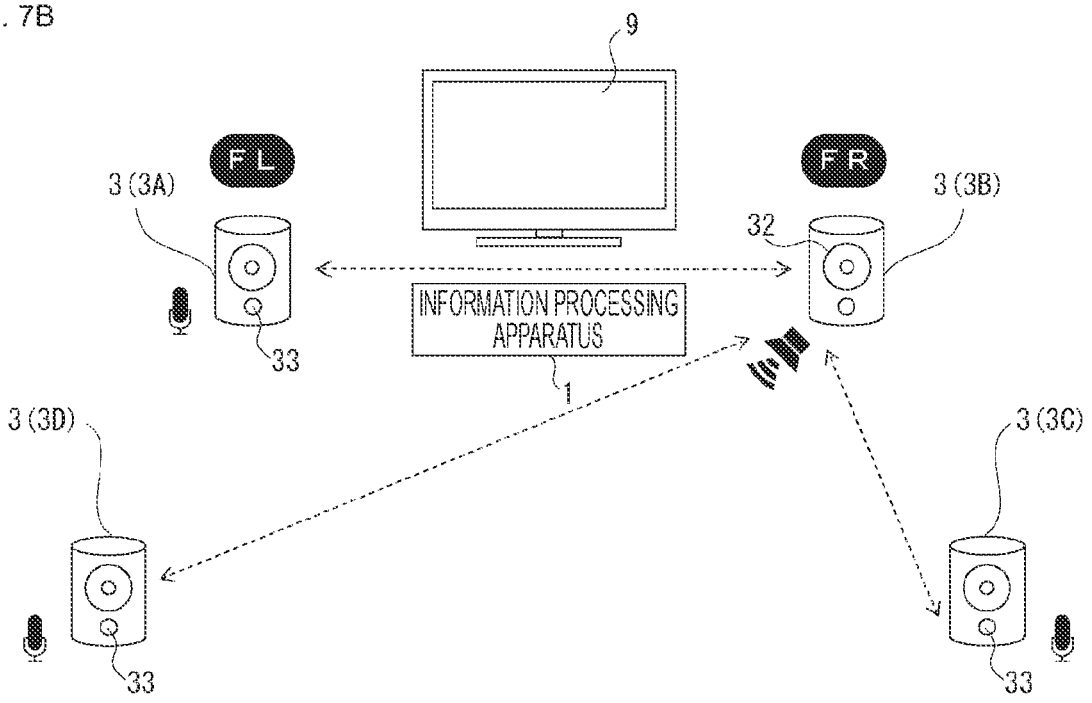

That is, as shown in FIG. 7A, the speaker 3A reproduces the test sound, the speakers 3B, 3C, 3D store the test sound and the time information, subsequently, the speaker unit 32 of the speaker 3B reproduces the test sound as shown in FIG. 7B, and the microphones 33 of the speakers 3A, 3C, and 3D collects the test sound, and store the test sound and the time information. Thus, the distance between the speakers 3B and 3A, the distance between the speakers 3B and 3C, and the distance between the speakers 3B and 3D shown by the broken lines are measured.

Although not shown, subsequently, the speaker 3C reproduces the test sound, and the speakers 3A, 3B, and 3D store the test sound and time information. Thus, the distance between the speakers 3C and 3A, the distance between the speakers 3C and 3B, and the distance between the speakers 3C and 3D are measured.

Furthermore, subsequently, the speaker 3D reproduces the test sound, and the speakers 3A, 3B, and 3C store the test sound and time information. Thus, the distance between the speakers 3D and 3A, the distance between the speakers 3D and 3B, and the distance between the speakers 3D and 3C are measured.

As described above, the distance of all the combinations of the speakers 3 can be measured.

Note that, when the test sound is reproduced/stored as described above, the time difference (distance) can be measured twice in one combination. It is desirable to reduce the measurement error by taking the average value twice.

Furthermore, in a case of further improving the efficiency of the initial setup, the test sound reproduction/storage processing may be ended at the time when the measurement for all the combinations is completed. For example, in the case described above, the test sound reproduction from the speaker 3D may be omitted. Moreover, in this case, the speaker 3 that has already performed reproduction may not perform the storage processing. For example, since the speaker 3A can measure the distance with each of the speakers 3B, 3C, and 3D after the reproduction by itself, the speaker 3A may not store the test sound from the speakers 3B, 3C, and as similar to this, the speaker 3B may not store the test sound from the speaker 3C.

When the distances among all the speakers 3 have been measured, the positional relationship among the speakers 3 is determined.

Figure 8A:
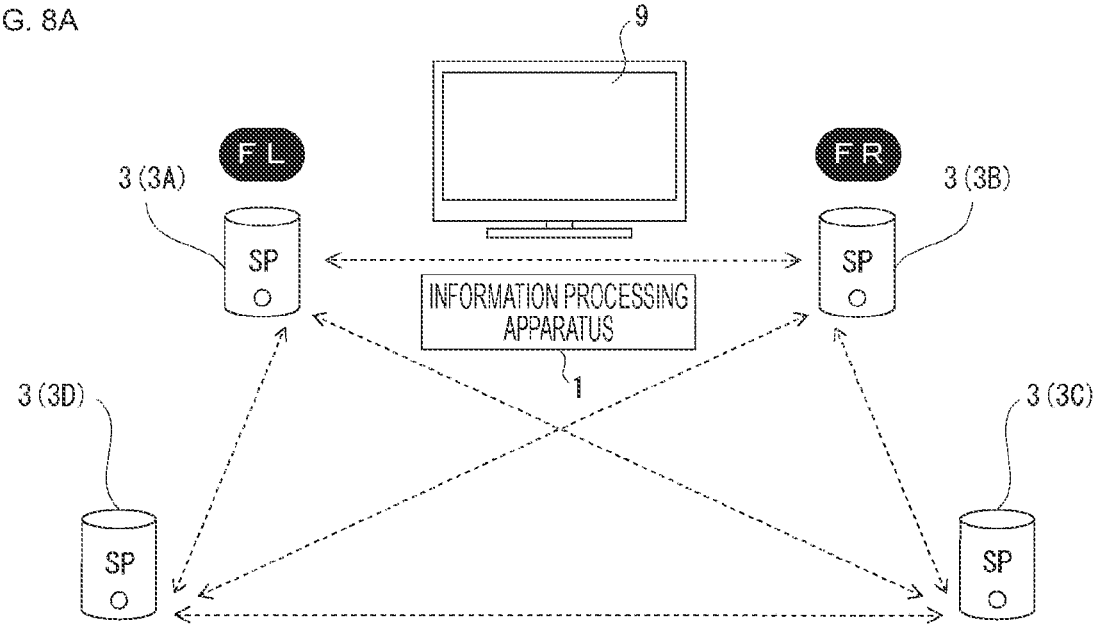
FIGS. 8A and 8B are explanatory diagrams of a channel setting step according to the embodiment.
Figure 8B:
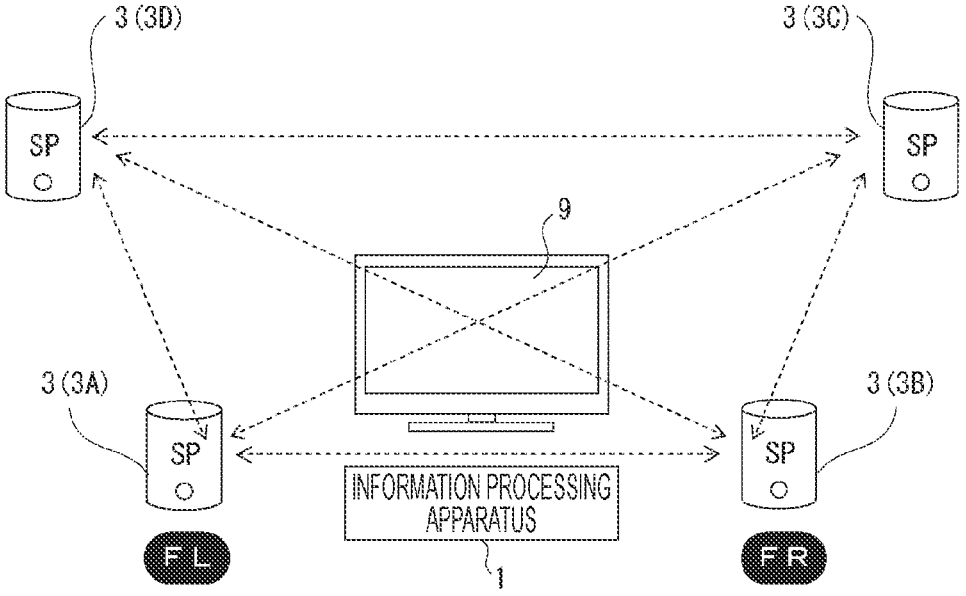

That is, the information processing apparatus 1 can recognize that, from the distances among the speakers 3, the arrangement state is either the state on FIG. 8A or 8B. FIGS. 8A and 8B are arrangements in a mirror image relationship in which the distances among the speakers 3 are the same.

Then, since the FL speaker 3A and the FR speaker 3B are already specified, the speakers 3A and 3B are on the front side, and therefore the information processing apparatus 1 can specify that FIG. 8A is the actual arrangement state.

That is, assuming that the remaining speakers 3 are located posterior to the user with respect to the FL speaker 3A and the FR speaker 3B, the possibility of speaker arrangement in FIG. 8B can be eliminated.

The information processing apparatus 1 automatically sets the channels (SL, SR) of all the remaining speakers on the basis of the relative positional relationship (FIG. 8A) between the speakers 3 determined as described above, and the estimated user orientation.

Figure 9A:
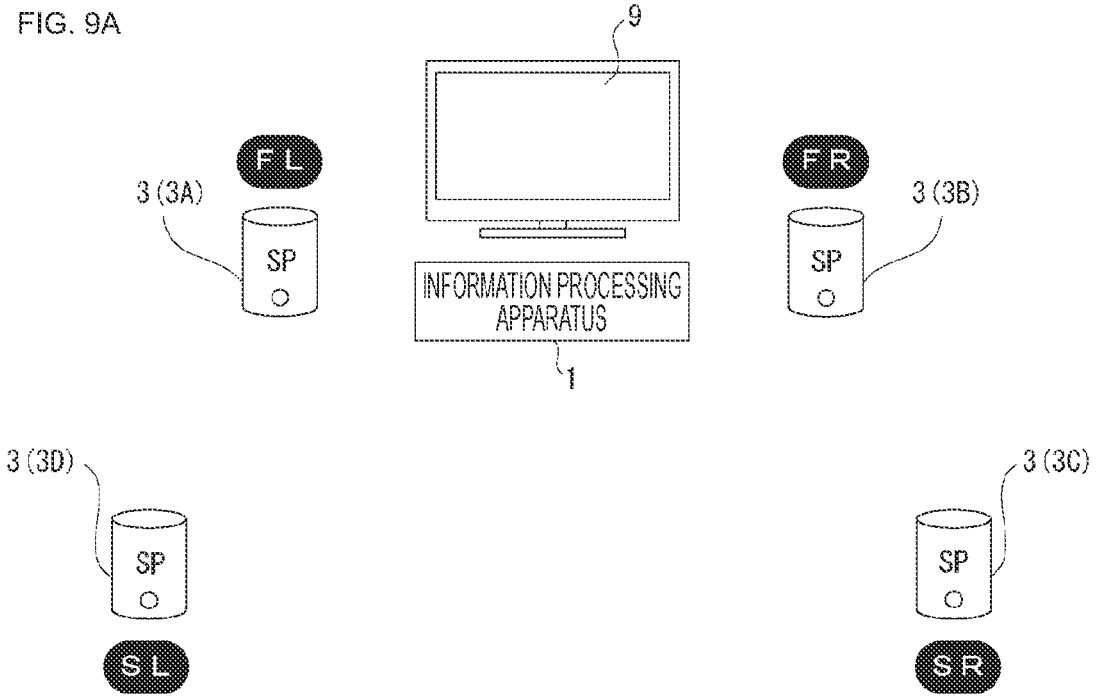
FIGS. 9A and 9B are explanatory diagrams of a channel setting step and virtual speaker setting of the embodiment.

That is, as shown in FIG. 9A, the speaker 3C is automatically set to the SR channel and the speaker 3D is automatically set to the SL channel.

With the above processing, the information processing apparatus 1 can be set with the FL speaker 3A, the FR speaker 3B, the SR speaker 3C, and the SL speaker 3D. That is, the FL channel, the FR channel, the SL channel, and the SR channel are assigned to the four speakers 3 that are arbitrarily arranged, according to the arrangement positions.

Moreover, the information processing apparatus 1 generates the position information of each speaker 3 on the basis of the relative positional relationship among the speakers 3 (FIG. 8A). The position information of each speaker 3 is represented, for example, as a coordinate value on a coordinate plane with the origin (0,0) being the speaker 3A to which the FL channel is assigned.

Note that the step described above is an example of step for performing channel setting, and the step is not limited to the above step as long as channel setting and position information acquisition of each speaker 3 are performed.

Furthermore, there is a technology as disclosed in, for example, U.S. Pat. No. 9,749,769, in which a virtual speaker is generated at an arbitrary position so that sound is heard as if it is from that position.

Figure 9B:
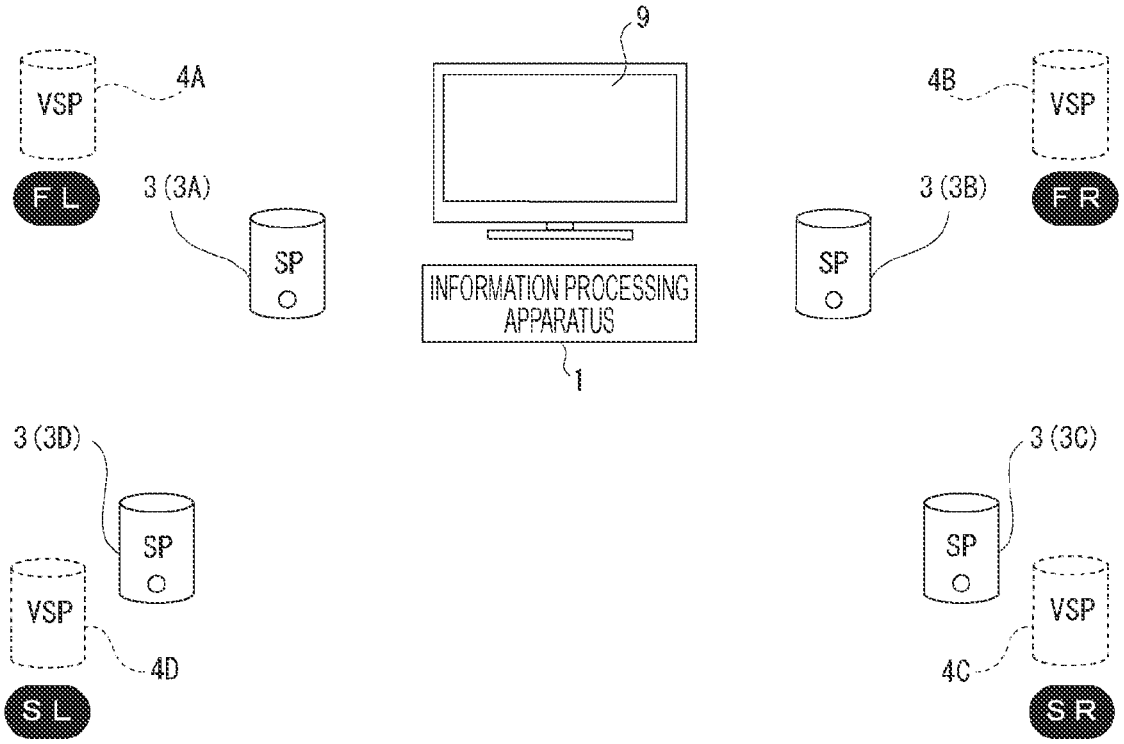

By using such a technology, as shown in FIG. 9B, virtual speakers 4 (4A, 4B, 4C, and 4D) are generated at positions different from the real speakers 3A, 3B, 3C, and 3D, and channels can be assigned to the generated virtual speakers 4A, 4B, 4C, and 4D.

More simply, a sound space can be created where sound is heard as if it is from the positions of the virtual speakers 4A, 4B, 4C, and 4D even though the sound is actually emitted from the speakers 3A, 3B, 3C, and 3D, also by the localization control using the mixing ratio of each channel sound signal or by delay time setting according to the difference between the positions of the virtual speaker setting 4 and the actual speaker 3.

By performing such virtual speaker setting, a surround sound environment can be more realized even in a case where the speaker arrangement is not necessarily appropriate for the surround sound system (or in a case where appropriate arrangement cannot be made due to the circumstances of the room).

Therefore, if the channel setting of the speaker 3 is performed as described above during the initial setup, the virtual speaker setting may be performed subsequently.

<3. User Listening Position Estimation and Virtual Speaker Arrangement Setting>

Subsequently, the estimation of the user listening position and the setting of the virtual speaker arrangement of the present embodiment performed in the above configuration will be described.

In the present embodiment, the user listening position is estimated using the position information of the speaker 3, and the virtual speaker arrangement is set on the basis of the estimated user listening position. By estimating the user listening position by using the position information of the already-arranged speaker, it is possible to set an appropriate virtual speaker arrangement for the listening position without any trouble for the user.

A step for estimating the user listening position and setting the virtual speaker arrangement will be described with reference to FIGS. 10 to 14.

As described above, in the present embodiment, the position of each speaker 3 is represented by the coordinates on the coordinate plane, and the position information of each speaker 3 is represented as the coordinate value calculated from the relative positional relationship of the plurality of speakers 3.

Figure 10:
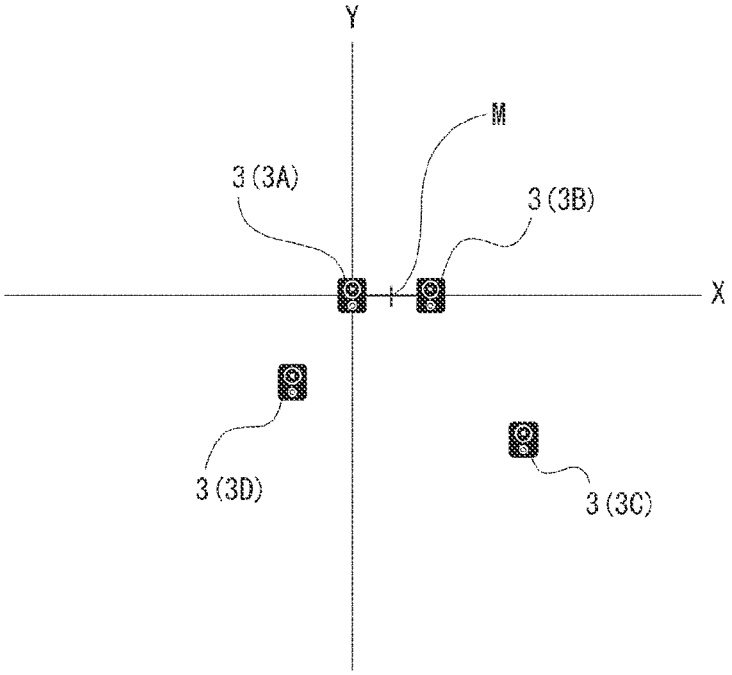
FIG. 10 is an explanatory diagram of user listening position estimation and a virtual speaker arrangement setting step according to the embodiment.

FIG. 10 shows, on the coordinate plane, the positions of the speakers 3A, 3B, 3C, and 3D for which channel setting has been performed by the step described in FIGS. 6A, 6B, 7A, 7B, 8A, 8B, and 9A and the like. In the coordinate plane used in FIG. 10 and the following description, the speaker 3A is set to the origin (0,0), the straight line passing through the FL speaker 3A and the FR speaker 3B is the X axis, and the straight line passing through the origin and orthogonal to the X axis is the Y axis. The array direction (X-axis direction) of the FL speaker 3A and the FR speaker 3B is the left and right direction for the user.

When the position information acquisition and channel setting of each speaker 3 described above are completed, as shown in FIG. 10, the information processing apparatus 1 recognizes the FL speaker 3A and the FR speaker 3B as standard speakers on the basis of the position information of each speaker 3. The midpoint M of the FL speaker 3A and the FR speaker 3B, which are standard speakers, is set as a reference position, and the SR speaker 3C located farthermost from the midpoint M is recognized as the farthermost speaker.

Note that the speakers that can be selected as the standard speakers are not limited to the FL speaker and the FR speaker. For example, in a speaker system including a center speaker, the center speaker may be recognized as the standard speaker and the position of the center speaker may be set as the reference position. In a case where the center speaker is arranged, the user is likely to listen in front of the center speaker, and therefore, by setting the center speaker as the standard speaker and the reference position, a reference position useful for estimating the user listening position can be obtained. Furthermore, in a case where there is a speaker arranged below the monitor device 9 used by the user for listening, the speaker may be recognized as the standard speaker and the position of the speaker may be set as the reference position.

Figure 11:
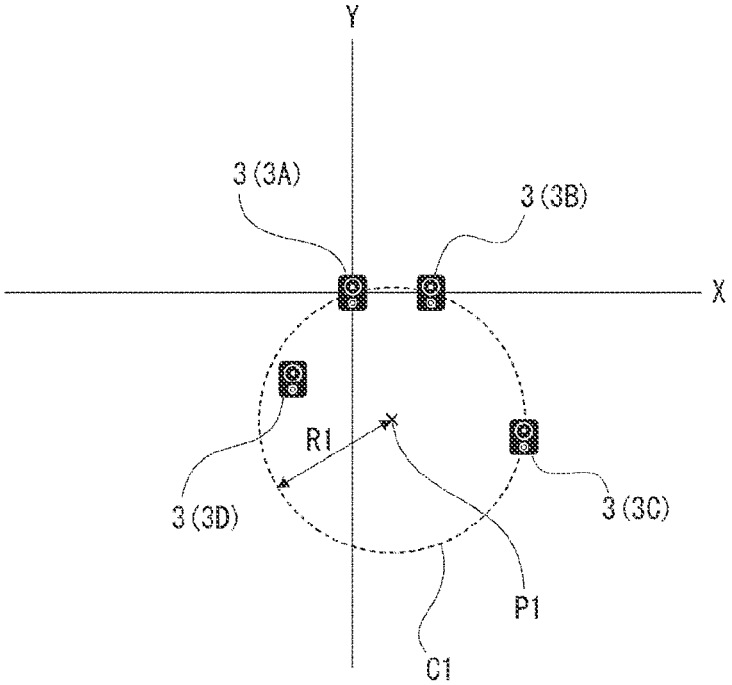
FIG. 11 is an explanatory diagram of user listening position estimation and a virtual speaker arrangement setting step according to the embodiment.

Subsequently, as shown in FIG. 11, the information processing apparatus 1 obtains a standard circle C1 passing through three points of the FL speaker 3A and the FR speaker 3B, which are standard speakers, and the SR speaker 3C, which is the farthermost speaker. At this time, the standard point P1 which is the center of the standard circle C1 and the radius R1 of the standard circle C1 are obtained. That is, the position information (coordinate value) of the standard point P1 and the length of the radius R1 are calculated.

Figure 12:
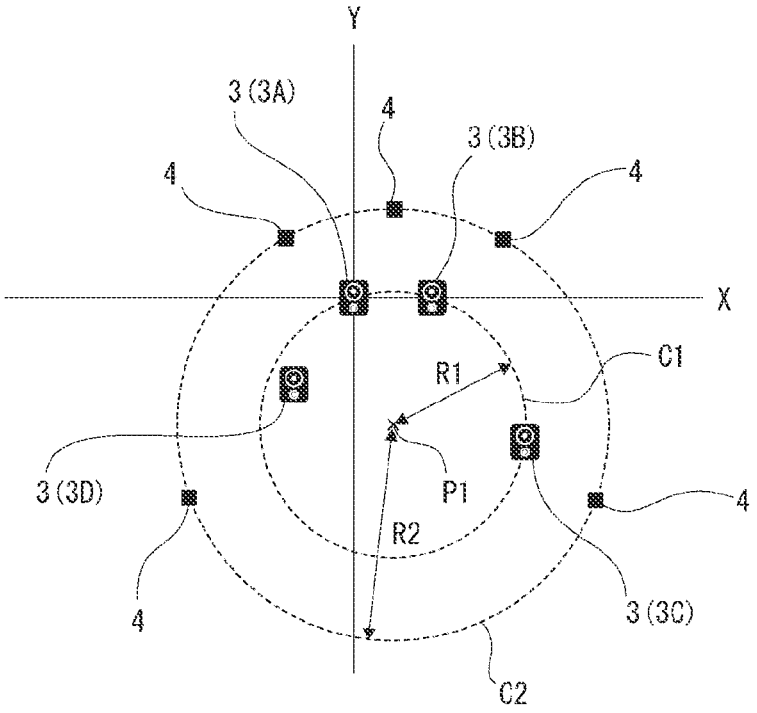
FIG. 12 is an explanatory diagram of user listening position estimation and a virtual speaker arrangement setting step according to the embodiment.

As shown in FIG. 12, the information processing apparatus 1 that has obtained the standard circle C1 obtains an enlarged circle C2 obtained by enlarging the standard circle C1 by predetermined constant multiplication. That is, the information processing apparatus 1 calculates the radius R2 of a length obtained by multiplying the radius R1 of the standard circle C1 by predetermined constant multiplication. Then, the enlarged circle C2 having the radius R2 centered on the standard point P1 is obtained.

In the example shown in FIG. 12, the predetermined constant multiple is 1.6, and the radius R2 of the enlarged circle C2 is set to a length obtained by multiplying the radius R1 of the standard circle C1 by 1.6. Note that the predetermined constant multiple is not limited to 1.6, and any constant multiple exceeding 1.0 can be selected according to the output of the speaker or the arrangement environment of the speaker system.

As shown in FIG. 12, the information processing apparatus 1 that has obtained the enlarged circle C2 sets virtual speaker arrangement on a circumference of the enlarged circle C2.

As the virtual speaker arrangement, for example, in accordance with the arrangement pattern of five channels defined by the International Telecommunication Union (ITU) recommendation, virtual positions (coordinates) are set so that each virtual speaker 4 is arranged at a predetermined angle on the circumference. Note that the virtual speaker arrangement is not limited to five channels, and virtual speaker arrangement corresponding to other multichannels such as seven channels may be set. Furthermore, the virtual speaker arrangement may be set on the basis of a standard other than the pattern defined by the ITU recommendation.

Figure 13:
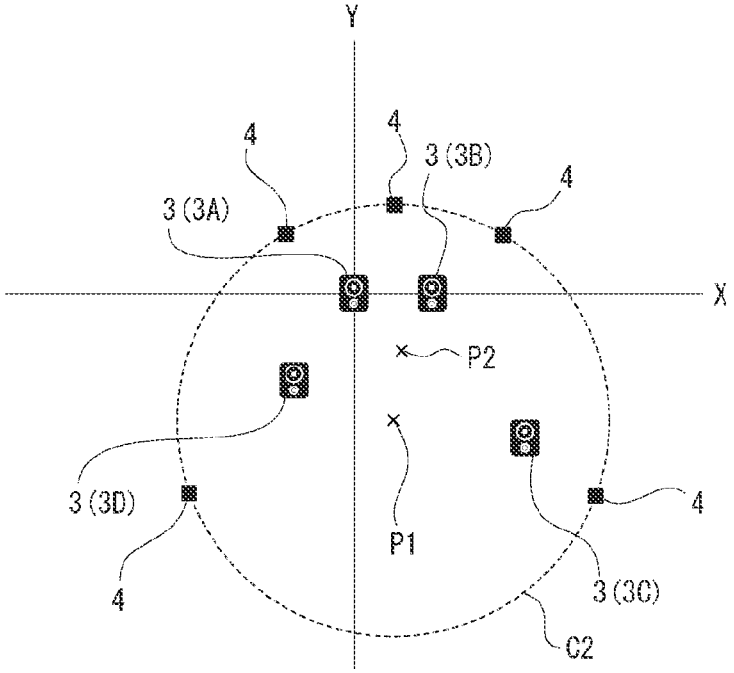
FIG. 13 is an explanatory diagram of user listening position estimation and a virtual speaker arrangement setting step according to the embodiment.

Subsequently, as shown in FIG. 13, the information processing apparatus 1 obtains the average position P2 of all the speakers 3 by using the position information of each speaker 3.

The position information of the average position P2 is represented as, for example, average coordinates calculated from the coordinates of the speakers 3A, 3B, 3C, and 3D. As the position information of the average position P2, each average coordinate in the X-axis direction (left and right direction) and the Y-axis direction (front and back direction), that is, both X-coordinate and Y-coordinate may be calculated, but at least the average coordinate (Y-coordinate) in the Y-axis direction is calculated.

Figure 14:
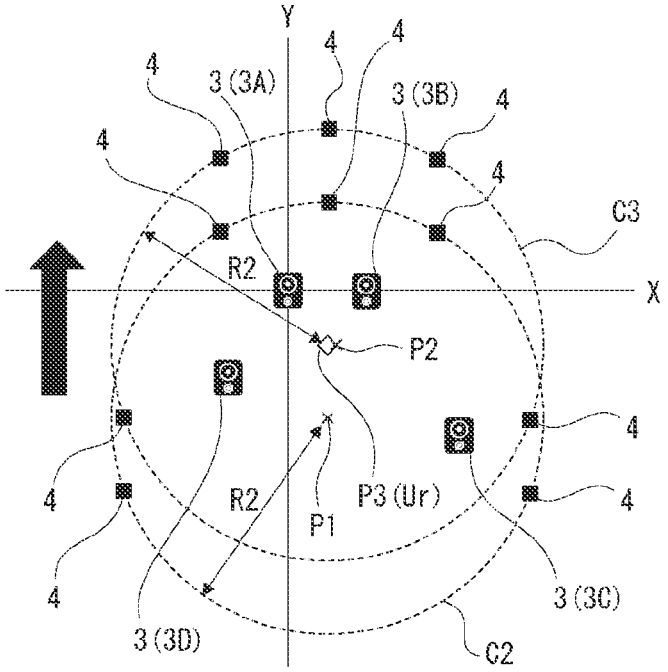
FIG. 14 is an explanatory diagram of user listening position estimation and a virtual speaker arrangement setting step according to the embodiment.

As shown in FIG. 14, the information processing apparatus 1 that has obtained the average position P2 obtains a movement point P3 at the point where the standard point P1 has been moved in the Y-axis direction on the basis of the position information of the average position P2, and estimates the movement point P3 as a user listening position Ur. Then, the information processing apparatus 1 obtains an arrangement circle C3 having the same radius R2 as the enlarged circle C2 centering on the user listening position Ur (movement point P3), and sets virtual speaker arrangement on a circumference of the arrangement circle C3. That is, in appearance, the virtual speaker arrangement on the circumferences of the enlarged circle C2 and the enlarged circle C2 are moved in the Y-axis direction.

At this time, the information processing apparatus 1 obtains the movement point P3 at the position where the standard point P1 is moved in the Y-axis direction to the position aligned with the average position P2 in the X-axis direction. That is, the movement point P3 has the X coordinate equal to the X coordinate of the standard point P1 and the Y coordinate equal to the Y coordinate of the average position P2.

When the standard point P1 is moved on the basis of the average position P2 as shown in FIG. 14, even in a case where the standard point P1 of the standard circle C1 deviates from the actual user listening position, a more appropriate position can be estimated as the user listening position Ur.

Figure 15:
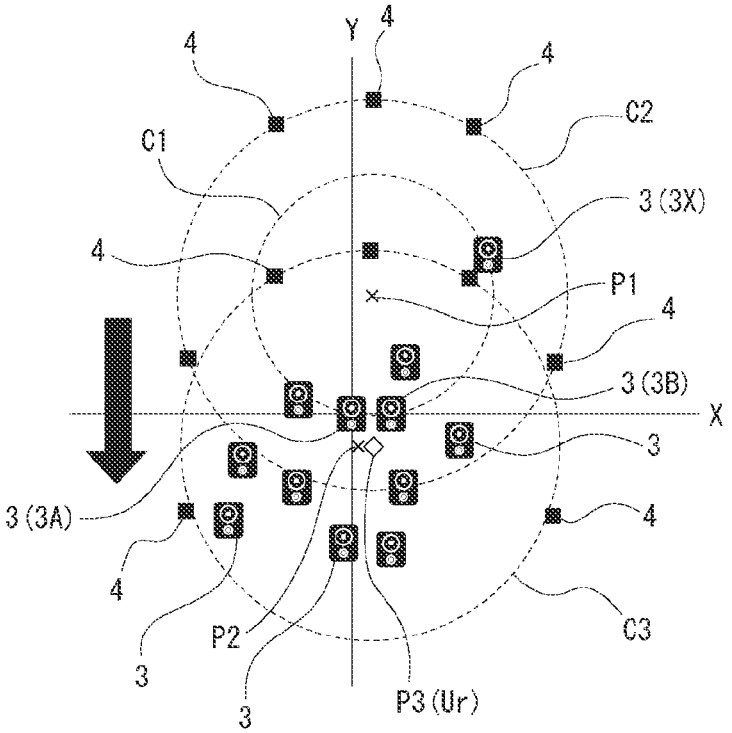
FIG. 15 is an explanatory diagram of another example of moving proessing according to the embodiment.

For example, as shown in FIG. 15, in a case where the farthermost speaker 3X is located in a position anterior to the standard speakers 3A and 3B, the standard point P1 that is the center of the standard circle C1 is set in a position anterior to the actual user listening position in some cases. Therefore, if the standard point P1 is regarded as the user listening position Ur, there is a possibility that the virtual speaker arrangement is set on the arrangement circle C3 centered on the user listening position Ur deviated from the actual user listening position.

Therefore, the average position P2 is obtained using the position information of all the speakers 3, and the standard point P1 (movement point P3) is moved so that the standard point P1 after being moved is aligned with the average position P2 in the X-axis direction, and thereby, it is possible to obtain more appropriate user listening position Ur and arrangement circle C3 that match the actual user listening position.

As described above, the user listening position Ur is estimated, and the virtual speaker arrangement is set on the circumference of the arrangement circle C3 centered on the user listening position Ur.

Note that, although it is conceivable that the user listening position Ur is estimated and the virtual speaker is arranged according to the step described above, the exceptional processing described below may be performed depending on the arrangement situation or the like of the speaker 3 and the virtual speaker 4.

For example, when the radius R2 of the arrangement circle C3 is larger than the reference radius R3 of a predetermined length, the virtual speaker arrangement may be reset.

Figure 16:
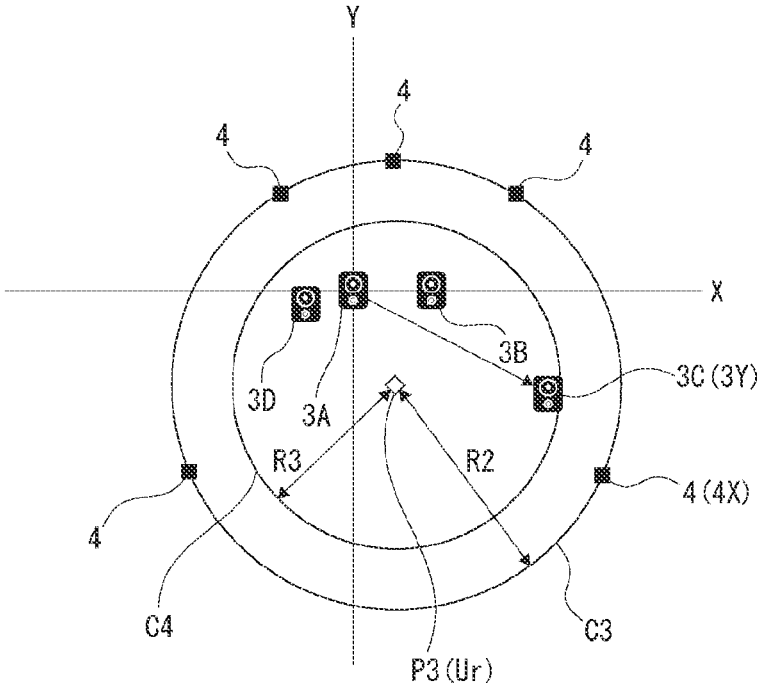
FIG. 16 is an explanatory diagram of exception processing according to the embodiment.

FIG. 16 shows a case where the radius R2 of the arrangement circle C3 is larger than the reference radius R3. Moreover, a rearmost virtual speaker 4X of all the virtual speakers 4 is located rearward of a rearmost speaker 3Y of all the speakers 3. That is, the Y coordinate of the virtual speaker 4X is smaller than the Y coordinate of the speaker 3Y. In such an arrangement situation, there is a possibility that the output of the virtual speaker 4X located at the rearmost position is not properly expressed by the real speaker 3.

Figure 17:
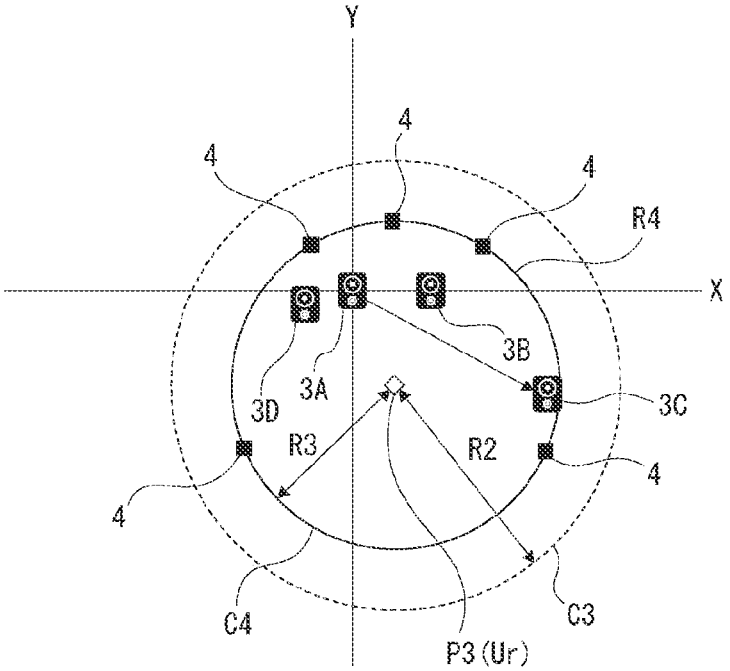
FIG. 17 is an explanatory diagram of exception processing according to the embodiment.

Therefore, in a case where the radius R2 of the arrangement circle C3 is larger than the reference radius R3 and the virtual speaker 4X located at the rearmost is located in a position posterior to the speaker 3Y located at the rearmost of all the speakers 3, that is, in a case where the Y coordinate of the virtual speaker 4X is smaller than the Y coordinate of the speaker 3Y, as shown in FIG. 17, the radius of the arrangement circle C3 is reset to a reference radius R3 of a predetermined length, and the virtual speaker arrangement is reset on the circumference of new arrangement circle of the reference radius R3. Here, such a new arrangement circle of the reference radius R3 is referred to as a reference circle C4. That is, as exceptional processing, the information processing apparatus 1 obtains the reference circle C4 of the reference radius R3 centered on the user listening position Ur, and resets the virtual speaker arrangement on the circumference of the reference circle C4.

By resetting the virtual speaker arrangement on the circumference of the new arrangement circle (reference circle C4) of the reference radius R3, it is possible to appropriately express the output of the virtual speaker 4 located at the rearmost position. Accordingly, a sound reproduction environment suitable for listening can be formed.

Note that the reference radius R3 of a predetermined length can be set to an arbitrary size according to the environment in which the speaker system is used and the output of the speaker 3. Therefore, the reference circle C4 having an appropriate size can be set according to the usage situation of the speaker system.

Figure 18:
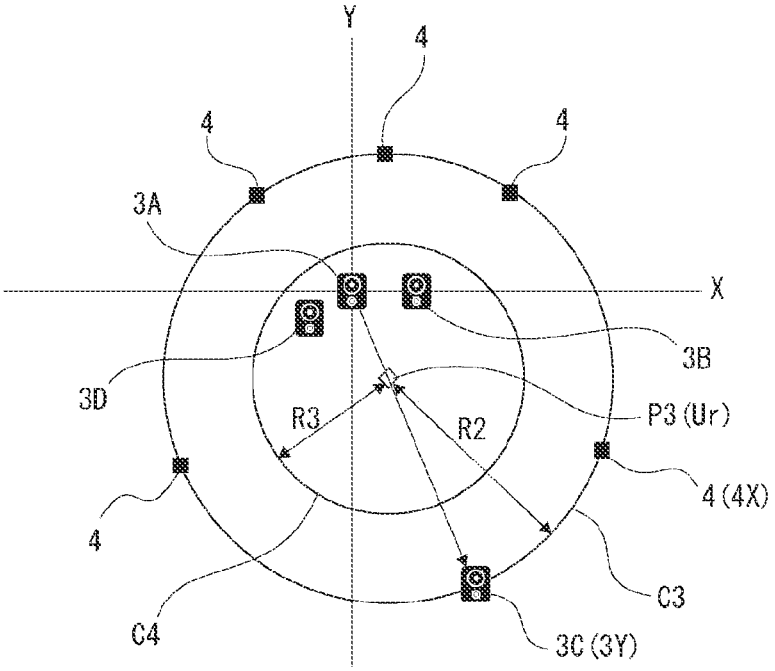
FIG. 18 is an explanatory diagram of exception processing according to the embodiment.

Note that, as shown in the arrangement example of FIG. 18, there is case where, even if the radius R2 of the arrangement circle C3 is larger than the reference radius 3R, the rearmost virtual speaker 4X is located in a position anterior to the rearmost speaker 3Y of all the speakers 3. That is, there is a case where the Y coordinate of the virtual speaker 4X is larger than the Y coordinate of the speaker 3Y.

In such a case, the output of the virtual speaker 4X can be appropriately expressed by the speaker 3, and thus the resetting described above does not necessarily have to be performed.

Figure 19:
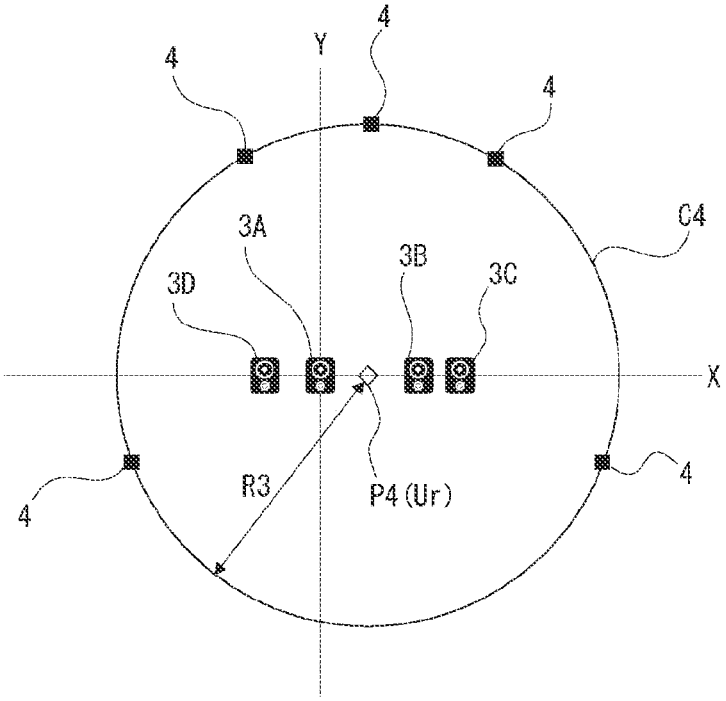
FIG. 19 is an explanatory diagram of exception processing according to the embodiment.

Furthermore, as shown in FIG. 19, all the speakers 3 of the speaker system are located substantially coaxially in the Y-axis direction (front and back direction) in some cases. In such speaker arrangement, the size (radius) of the standard circle Cl and the arrangement circle C3 (enlarged circle C2) obtained by the step described above is large. However, if the sound field obtained by the virtual speaker arrangement set on the circumference of the arrangement circle C3 is too large, there is a possibility that a sound reproduction environment suitable for listening cannot be formed.

Therefore, in a case where all the speakers 3 of the speaker system are located within a predetermined range in the Y-axis direction, for example, within a range of 10 cm, the information processing apparatus 1 obtains the center position P4 on the basis of the position information of the plurality of speakers 3, and estimates the center position P4 as the user listening position Ur. Moreover, it is conceivable that an arrangement circle (reference circle C4) having the reference radius R3 of a predetermined length as a radius and having the user listening position Ur as the center is obtained, and virtual speaker arrangement is set on the circumference of the reference circle C4.

For example, FIG. 19 shows a state in which four speakers 3A, 3B, 3C, and 3D are arrayed in the X-axis direction and have the same Y coordinate. At this time, the information processing apparatus 1 calculates the X coordinate of the midpoint using the position information of the FL speaker 3A and the FR speaker 3B as the standard speakers, and obtains the X coordinate as the X coordinate of the center position P4. Moreover, the information processing apparatus 1 uses the position information of the speakers 3A, 3B, 3C, and 3D to calculate the Y coordinate of the average position of all the speakers 3 in the Y-axis direction, and obtains the Y coordinate as the Y coordinate of the center position P4. The information processing apparatus 1 estimates the center position P4 thus obtained as the user listening position Ur, and obtains the reference circle C4 of the reference radius R3 centered on the user listening position Ur. Subsequently, the virtual speaker arrangement is set on the circumference of the reference circle C4.

Therefore, the virtual speaker arrangement can be set on the circumference of the arrangement circle (reference circle C4) of the reference radius R3 of a predetermined length, and a sound field of an appropriate size can be obtained.

<4. Processing Example>

The processing of the information processing apparatus 1 for achieving the estimation of the user listening position and the setting of the virtual speaker arrangement as described above will be described with reference to FIG. 20. The processing of the information processing apparatus 1 is processing mainly executed by the functions of the estimation part 110 and the arrangement part 111 in the virtual speaker setting part 11*c* in the CPU 11.

Figure 20:
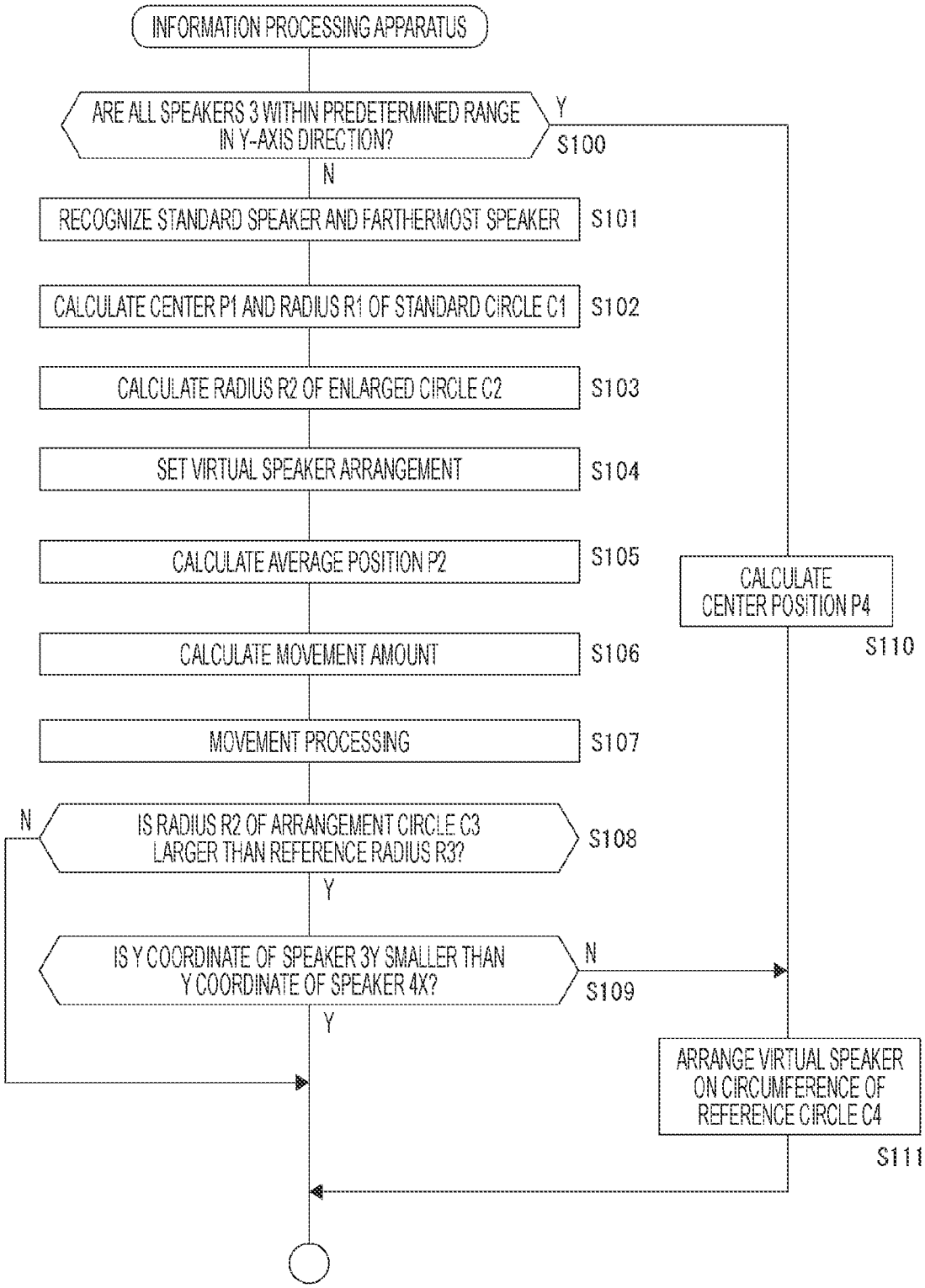
FIG. 20 is a flowchart of processing of the embodiment.

Furthermore, FIG. 20 shows processing from the time when the position information of each speaker 3 is acquired by the information processing apparatus 1 and the channel is assigned to each speaker 3.

In step S100, the CPU 11 of the information processing apparatus 1 determines whether or not all the speakers 3 of the speaker system are located within a predetermined range in the Y-axis direction (front and back direction).

In a case where it is determined that all the speakers 3 are located within the predetermined range in the Y-axis direction, the process proceeds to step S110 and the CPU 11 obtains the center position P4 using the position information of the speakers 3. That is, the CPU 11 uses the position information of the FL speaker 3A and the FR speaker 3B, which are the standard speakers, to calculate the X coordinate of the midpoint of the FL speaker 3A and the FR speaker 3B. Moreover, the CPU 11 uses the position information of all the speakers 3 to calculate the Y coordinate of the average position of all the speakers 3 in at least the front and back direction. After setting the X and Y coordinates calculated as described as the coordinate values of the center position P4, the CPU 11 estimates the center position P4 as the user listening position Ur (see FIG. 19). After the CPU 11 finishes the processing of step S110, the process proceeds to the processing of step S111 as described later.

Furthermore, in a case where the CPU 11 determines in step S100 that all the speakers 3 are not located within the predetermined range in the Y-axis direction, the process proceeds to the processing of step S101.

In step S101, the CPU 11 recognizes the standard speakers (speaker 3A and FR speaker 3B) of all the speakers 3, and the farthermost speaker (speaker 3C) located farthermost from the reference position (midpoint M) determined according to the standard speakers (see FIG. 10).

Then, in step S102, the CPU 11 obtains the standard circle Cl passing through the standard speakers and the farthermost speaker (see FIG. 11). At this time, the position information (coordinate value) of the standard point P1 which is the center of the standard circle C1 and the radius R1 are calculated.

In step S103, the CPU 11 enlarges the standard circle C1 by predetermined constant multiplication (see FIG. 12). That is, the radius R2 is calculated by multiplying the radius R1 by predetermined constant multiplication. At this time, the enlarged circle C2 that is a circle having the radius R2 and having the standard point P1 as a center is obtained.

Subsequently, in step S104, the CPU 11 sets virtual speaker arrangement on the circumference of the enlarged circle C2 (see FIG. 12). As the virtual speaker arrangement, for example, the position information (coordinate value) of each virtual speaker 4 is obtained so as to be arranged on the circumference of the enlarged circle C2 according to the speaker arrangement pattern of five channels based on the ITU recommendation.

In step S105, the CPU 11 uses the position information of each speaker 3 to obtain the average position P2 of all the speakers 3 (see FIG. 13). That is, the average coordinates of all the speakers 3 are calculated on the basis of the coordinates of each speaker 3, and the value is set as the coordinate value of the average position P2.

Note that, as the average position P2, it is sufficient that position information (Y coordinate) of the average position of all the speakers 3 at least in the front and back direction is obtained.

Subsequently, in step S106, the CPU 11 compares the position information of the standard point P1 and the position information of the average position P2 to calculate the movement amount. The movement amount here is a difference in the Y-axis direction (front and back direction) between the standard point P1 and the average position P2, and can be expressed as, for example, the difference between the Y coordinate value of the standard point P1 and the Y coordinate value of the average position P2.

In step S107, the CPU 11 performs movement processing of moving the enlarged circle C2 in the front and back direction according to the movement amount (see FIG. 14). That is, the movement point P3 is determined at a position where the standard point P1 which is the center of the enlarged circle C2 is moved in the front and back direction (Y-axis direction) according to the movement amount, and the arrangement circle C3 having the radius R2 and having the movement point P3 as the center is obtained.

The movement point P3 is located to be aligned with the average position P2 in the left and right direction (X-axis direction). The position information (coordinate value) of the movement point P3 is calculated assuming that the X coordinate is equal to the X coordinate of the standard point P1 and the Y coordinate is equal to the Y coordinate of the average position P2. The CPU 11 estimates such a movement point P3 at the user listening position Ur.

With the movement of the enlarged circle C2, the virtual speaker arrangement set on the circumference of the enlarged circle C2 is also moved. That is, the CPU 11 moves the virtual speaker arrangement set in step S104 in the front and back direction (Y-axis direction) according to the movement amount, and sets the virtual speaker arrangement on the circumference of the arrangement circle C3. The position information of each virtual speaker 4 after movement is represented by the X coordinate of each virtual speaker 4 determined in step S104 and the Y coordinate obtained by increasing or decreasing the Y coordinate determined in step S104.

In step S108, the CPU 11 determines whether or not the radius R2 of the arrangement circle C3 is larger than the reference radius R3 having a predetermined length.

In a case where it is determined that the radius R2 of the arrangement circle C3 is not larger than the reference radius R3, the CPU 11 ends the processing shown in FIG. 17.

In a case where the CPU 11 determines in step S108 that the radius R2 of the arrangement circle C2 is larger than the reference radius R3, the process proceeds to the processing of step S109.

In step S109, the CPU 11 detects the rearmost speaker 3Y of all the speakers 3 and the virtual speaker 4X set to the rearmost of all the virtual speakers 4, and determines whether or not the speaker 3Y is located in a position posterior to the virtual speaker 4X. That is, the position information of the speaker 3Y and the position information of the virtual speaker 4X are compared to determine whether or not the Y coordinate of the speaker 3Y is smaller than the Y coordinate value of the virtual speaker 4X.

In a case where it is determined in step S109 that the Y coordinate of the speaker 3Y is smaller than the Y coordinate of the virtual speaker 4X, that is, in a case where it is determined that the speaker 3Y is located in a position posterior to the virtual speaker 4X, the CPU 11 of the information processing apparatus 1 ends the processing shown in FIG. 17. In this case, the virtual speaker arrangement is set on the circumference of the arrangement circle C3 (see FIG. 18).

In a case where it is determined in step S109 that the Y coordinate of the speaker 3Y is not smaller than the Y coordinate of the virtual speaker 4X, that is, in a case where it is determined that the speaker 3Y is located in a position posterior to the virtual speaker 4Y, the process of the CPU 11 proceeds to the processing in step S111 (see FIG. 16).

In step S111, the CPU 11 obtains the reference circle C4 of the reference radius R3 centered on the user listening position Ur, and sets the virtual speaker arrangement on the circumference of the reference circle C4, and ends the processing of FIG. 17 (see FIGS. 18 and 19).

As the virtual speaker arrangement, for example, the position information (coordinate value) of each virtual speaker 4 is determined so as to be arranged on the circumference of the reference circle C4 according to the speaker arrangement pattern of five channels based on the ITU recommendation.

Through the above processing, the user listening position Ur is estimated using the position information of the speaker 3, and the virtual speaker arrangement is set on the basis of the user listening position Ur. Therefore, the user listening position Ur can be estimated without burdening the user, and a sound reproduction environment suitable for listening from the user listening position Ur can be formed.

Note that the processing shown in steps S101 to S107 may be performed in a different step from the above as long as the information (user listening position Ur and radius R2) necessary to obtain the arrangement circle C3 is obtained before the exception processing in step S108 and subsequent steps is performed.

For example, in the processing example described above, although the virtual speaker arrangement is set in each of step S104 and step S107, it is conceivable that the virtual speaker arrangement setting in step S104 is not performed. In this case, the virtual speaker arrangement is set for the first time at the stage where the movement point P3 and the arrangement circle C3 are obtained in the movement processing of step S107.

Furthermore, in the processing example described above, although the radius R2 is obtained in the enlarging processing in step S103 and, then, the user listening position Ur is obtained by moving the standard point P1 in step S107, it is conceivable that the enlarging processing is performed after obtaining the user listening position Ur. In this case, for example, the virtual speaker arrangement in step S104 may not be performed, the standard point P1 may be first obtained in step S107 to obtain the movement point P3 (user listening position Ur), and then the radius R1 of the standard circle C1 may be multiplied by a constant to obtain the radius R2.

<5. Summary and Modification>

The information processing apparatus 1 of the embodiment estimates the user listening position Ur by using the position information of the N speakers 3 that are three or more speakers, by the function of the estimation part 110 of the virtual speaker setting part 11*c* (S101 to 107, S110 in FIG. 17). Furthermore, the function of the arrangement part 111 of the virtual speaker setting part 11*c* sets the virtual speaker arrangement by using the user listening position Ur (S107, S111).

In such user listening position estimation processing and virtual speaker arrangement setting processing, the information processing apparatus 1 can first estimate the user listening position Ur on the basis of the position information of the N speakers 3. Since the user listening position is estimated on the basis of the position information of the speaker 3 that has already been placed, the user does not have to take the burden of notifying the information processing apparatus 1 of his own listening position by some operation or the like, and there is no trouble for the user.

Furthermore, the information processing apparatus 1 can set the virtual speaker arrangement on the basis of the estimated user listening position Ur. Depending on the environment in which the speaker 3 is actually arranged, the speaker 3 may not be arranged at the optimum position for listening because of the size and shape of the room, the arrangement of furniture, and the like. However, by setting the virtual speaker arrangement on the basis of the user listening position Ur, a sound reproduction environment (sound field) optimal for listening is formed even in such a usage environment. Accordingly, a sound reproduction environment suitable for listening can be obtained without being influenced by the actual speaker arrangement environment.

By the function of the arrangement part 111, the information processing apparatus 1 according to the embodiment sets an arrangement circle centered on the user listening position Ur to set the virtual speaker arrangement so that the virtual speaker 4 is arranged on a circumference of the arrangement circle (S107, S111).

Therefore, the virtual speaker arrangement is set on the circumference of the arrangement circle (arrangement circle C3, reference circle C4) centered on the user listening position Ur. Since the virtual speaker arrangement is set around the estimated user listening position Ur, a sound reproduction environment suitable for listening can be obtained.

By the function of the estimation part 110, the information processing apparatus 1 of the embodiment recognizes a standard speaker, among the N speakers 3, and a farthermost speaker that is located farthermost from a reference position determined according to the standard speaker (S101), and performs processing of obtaining a standard circle C1 passing through the standard speaker and the farthermost speaker (S102) and processing of moving a center (standard point P1) of the standard circle C1 on the basis of position information of the N speakers to estimate the center (movement point P3) of the standard circle (arrangement circle C3) after being moved as the user listening position Ur (S107).

Of all the speakers 3, the standard speakers (3A and 3B) and the farthermost speaker (3C) located farthermost from the reference position determined according to the standard speakers are used to obtain the standard circle C1, so that the standard circle C1 as large as possible is obtained. By obtaining the standard circle C1 as large as possible, it is possible to prevent the arrangement circle 3C in which the virtual speaker arrangement is set from becoming too small, and to form a sound reproduction environment having an appropriate spread.

Moreover, by moving the standard point P1 that is the center of the standard circle C1 on the basis of the position information of the N speakers 3, the user listening position Ur (movement point P3) that reflects an actual arrangement situation of the speakers 3 can be estimated. Therefore, even in case where the farthermost speaker is arranged at a position extremely apart from the other speakers, it is possible to estimate a position more suitable as the actual user listening position as the user listening position Ur in consideration of the overall arrangement situation of the speakers 3 in the speaker system.

The information processing apparatus 1 according to the embodiment performs processing (S103) of enlarging the radius R1 of the standard circle C1 by predetermined constant multiplication by the function of the arrangement part 111.

By enlarging the radius R1 of the standard circle C1 by predetermined constant multiplication, the radius R2 having a size obtained by enlarging the radius R1 by predetermined constant multiplication is calculated. Therefore, the arrangement circle C3 having the radius R2 can be obtained and the virtual speaker arrangement can be set on the circumference of the arrangement circle C3. Accordingly, a more appropriate sound field can be formed according to the actual output of the speaker 3 and the usage environment of the speaker 3.

In the embodiment, the front left speaker 3A and the front right speaker 3B are the standard speakers, and the reference position is the midpoint M of the front left speaker 3A and the front right speaker 3B.

By using the front left speaker 3A and the front right speaker 3B as the standard speakers, the midpoint M of the front left speaker 3A and the front right speaker 3B is estimated as the user listening position Ur in the left and right direction (X-axis direction). Accordingly, it is possible to obtain a suitable reference position for estimating the user listening position Ur in the left and right direction.

In the embodiment, it is also conceivable that a front center speaker is the standard speaker, and the reference position is a position where the front center speaker is arranged.

Therefore, in a case where a front center speaker, such as a center speaker that is likely to be arranged in front of the actual user listening position, is arranged, it is possible to obtain a reference position suitable for estimating the user listening position Ur in the left and right direction (X-axis direction) by using the front center speaker as the standard speaker instead of the front right speaker and the front left speaker.

In the embodiment, by the function of the estimation part 110, the average position P2 in at least the front and back direction of the N speakers 3 is obtained by using the position information of the N speakers 3 (3A, 3B, 3C, and 3D) (S105), and the standard point P1 that is the center of the standard circle Cl and the enlarged circle C2 is moved in the front and back direction to a position aligned with the average position P2 in the left and right direction (S107).

The average position P2 in at least the front and back direction of the N speakers 3 is obtained, and the standard point P1 that is the center of the standard circle C1 (enlarged circle C2) is moved in the front and back direction (Y-axis direction) to the position aligned with the average position P2 in the left and right direction (X-axis direction), so that the center (movement point P3) of the standard circle (arrangement circle C3) after being moved is estimated as the user listening position Ur. By using the average position P2 of the N speakers 3 in the front and back direction, an appropriate user listening position can be estimated in consideration of the actual arrangement state of the speakers 3.

Note that, in a speaker system including a subwoofer, the average position P2 may be calculated using the position information of the speaker 3 excluding the subwoofer. Therefore, it is possible to obtain the average position of only the speaker 3 that contributes to the surround effect among all the speakers 3.

In a case where the radius of the arrangement circle C3 is larger than the radius of the predetermined length (reference radius R3) and the virtual speaker (virtual speaker 4X) arranged on the circumference of the arrangement circle C3 is in a position posterior to any speaker (speaker 3Y), the information processing apparatus 1 of the embodiment sets the radius of the arrangement circle to a radius of a predetermined length (reference radius R3), and resets the virtual speaker arrangement, by the function of the arrangement part 111. That is, the reference circle C4 having a radius of a predetermined length (reference radius R3) is determined as a new arrangement circle, and the virtual speaker arrangement is reset on the circumference of the reference circle C4.

In a case where the radius R2 of the arrangement circle C3 that is once set is larger than the radius of the predetermined length (reference radius 3R) and a certain virtual speaker 4X is arranged in a position posterior to the actual speaker 3Y, there is a possibility that the output of the virtual speaker 4 cannot be expressed appropriately. Then, the reference circle C4 having a radius of a predetermined length (reference radius 3R) is determined as a new arrangement circle, and the virtual speaker arrangement is reset on the circumference of the reference circle C4.

Therefore, even in a case where the arrangement circle C3 is larger than the predetermined size, the virtual speaker arrangement is set on the circumference of the reference circle C4 as a new arrangement circle having a radius of the predetermined length (reference radius R3), and the sound effect of each virtual speaker 4 can be appropriately formed.

In a case where the N speakers 3 are located within a predetermined range in the front and back direction, the information processing apparatus 1 of the embodiment estimates, by the function of the estimation part 110, the user listening position Ur by using the position information of the standard speaker and the position information of the average position P2 in the front and back direction of the N speakers 3 (S110), and sets, by the arrangement part 111, the radius of the arrangement circle to the predetermined length (reference radius 3R).

In a case where the N speakers 3 are located within a predetermined range in the front and back direction (for example, within a range of 10 cm in width), when the standard circle C1 passing through the standard speaker and the farthermost speaker is obtained, the arrangement circle C3 calculated on the basis of the standard circle C1 is excessively large, and there is a possibility that a sound field of a suitable size cannot be formed. Therefore, the information processing apparatus 1 uses the position information of the standard speaker to obtain the position (X coordinate) of the user listening position Ur in the left and right direction (X-axis direction), uses the position information of the average position P2 in the front and back direction (Y-axis direction) of the N speakers 3 to obtain the position (Y coordinate) of the user listening position Ur in the front and back direction, and thereby, estimates the user listening position Ur (center position P4). By setting the radius length to a predetermined length (reference radius R3), the arrangement circle (reference circle C4) centered on the user listening position Ur thus estimated is obtained, and the virtual speaker arrangement is set on the circumference of the arrangement circle (reference circle C4).

Therefore, even in a case where the N speakers 3 are located within a predetermined range in the front and back direction, it is possible to perform virtual speaker arrangement for forming a sound reproduction environment suitable for listening.

Note that, although the arrangement circle C3 centered on the movement point P3 or the center position P4 is obtained in the above, the arrangement circle for setting the virtual speaker arrangement may be obtained by another method using the position information of the speaker 3. For example, a circle that minimizes the sum of squares of the circumference and the distance among the speakers 3 (least square circle) may be obtained as the arrangement circle.

The program of the embodiment is a program that causes, for example, a CPU, a digital signal processor (DSP) or the like, or an information processing apparatus as a device including these to perform functions as the relative position recognition part 11*a*, the channel setting part lib, the virtual speaker setting part 11*c* (estimation part 110, arrangement part 111), and the channel signal processing part 11*d*.

That is, the program of the embodiment is a program that causes an information processing apparatus to perform processing of estimating the user listening position Ur by using the position information of the N speakers 3 that are three or more speakers and processing of setting the virtual speaker arrangement by using the user listening position Ur.

The information processing apparatus 1 of the present disclosure can be achieved by such a program.

Such a program can be recorded in advance in a hard disk drive (HDD) as a recording medium incorporated in a device such as a computer device, a ROM in a microcomputer having a CPU, or the like.

Alternatively, the program can be temporarily or permanently stored (recorded) in a removable recording medium such as a flexible disk, a compact disc read only memory (CD-ROM), a magneto optical (MO) disk, a digital versatile disc (DVD), a Blu-Ray Disc (registered trademark), a magnetic disk, a semiconductor memory, or a memory card. Such a removable recording medium can be provided as so-called package software.

Furthermore, such a program can be installed from a removable recording medium to a personal computer or the like, or can also be downloaded from a download site via a network such as a local area network (LAN) or the Internet.

Furthermore, such a program is suitable for providing a wide range of the information processing apparatus 1 of the embodiment. For example, by downloading the program to various audio equipment equipped with an operation processing device, personal computer, portable information processing device, mobile phone, game device, video device, personal digital assistant (PDA) or the like, such devices can be used as the information processing apparatus 1 of the present disclosure.

Note that the effects described in the present specification are merely examples and are not intended to be limiting, and other effects may be provided.

Note that the present technology can adopt the following configuration.

(1)

An information processing apparatus including:

an estimation part that estimates a user listening position by using position information of N speakers that are three or more speakers; and an arrangement part that sets virtual speaker arrangement by using the user listening position.

(2)

The information processing apparatus according to (1) above, in which the arrangement part sets an arrangement circle centered on the user listening position and sets the virtual speaker arrangement so that a virtual speaker is arranged on a circumference of the arrangement circle.

(3)

The information processing apparatus according to (1) or (2) above, in which the estimation part recognizes a standard speaker, among the N speakers, and a farthermost speaker that is located farthermost from a reference position determined according to the standard speaker, and performs processing of obtaining a standard circle passing through the standard speaker and the farthermost speaker and processing of moving a center of the standard circle on the basis of the position information of the N speakers to estimate the center of the standard circle after being moved as the user listening position.

(4)

The information processing apparatus according to (3) above, in which the arrangement part performs processing of enlarging a radius of the standard circle by predetermined constant multiplication.

(5)

The information processing apparatus according to any one of (3) or (4) above, in which a front left speaker and a front right speaker are the standard speakers, and the reference position is a midpoint between the front left speaker and the front right speaker.

(6)

The information processing apparatus according to (3) or (4) above, in which a front center speaker is the standard speaker, and the reference position is a position where the front center speaker is arranged.

(7)

The information processing apparatus according to any one of (3) to (6) above, in which the estimation part obtains an average position in at least a front and back direction of the N speakers using the position information of the N speakers, and moves the center of the standard circle in the front and back direction up to a position aligned with the average position in a left and right direction.

(8)

The information processing apparatus according to any one of (2) to (7) above, in which, in a case where a radius of the arrangement circle is larger than a predetermined length and the virtual speaker arranged on a circumference of the arrangement circle is posterior to any of the speakers, the arrangement part sets the radius of the arrangement circle to a radius of the predetermined length and resets virtual speaker arrangement.

(9)

The information processing apparatus according to any one of (2) to (7) above, in which, in a case where the N speakers are located within a predetermined range in a front and back direction, the estimation part estimates the user listening position by using position information of the standard speaker and position information of an average position in the front and back direction of the N speakers, and the arrangement part sets a radius of the arrangement circle to a radius of a predetermined length.

(10)

An information processing method, in which an information processing apparatus performs:

an estimating step of estimating a user listening position by using position information of N speakers that are three or more speakers; and an arranging step of setting virtual speaker arrangement by using the user listening position.

(11)

The information processing method according to (10) above, in which, the arranging step includes setting an arrangement circle centered on the user listening position and sets the virtual speaker arrangement so that a virtual speaker is arranged on a circumference of the arrangement circle.

(12)

The information processing method according to (10) or (11) above, in which the estimating step includes recognizing the standard speaker, among the N speakers, and a farthermost speaker that is located farthermost from a reference position determined according to the standard speaker, and performing processing of obtaining a standard circle passing through the standard speaker and the farthermost speaker and processing of moving a center of the standard circle on the basis of position information of the N speakers to estimate the center of the standard circle after being moved as the user listening position.

(13)

The information processing method according to (12) above, in which the arranging step includes performing processing of enlarging a radius of the standard circle by predetermined constant multiplication.

(14)

The information processing method according to (12) or (13) above, in which a front left speaker and a front right speaker are the standard speakers, and the reference position is a midpoint between the front left speaker and the front right speaker.

(15)

The information processing method according to (12) or (13) above, in which a front center speaker is the standard speaker, and the reference position is a position where the front center speaker is arranged.

(16)

The information processing method according to any one of (12) to (15) above, in which the estimating step includes obtaining an average position in at least a front and back direction of the N speakers using the position information of the N speakers, and moving the center of the standard circle in the front and back direction up to a position aligned with the average position in a left and right direction.

(17)

The information processing method according to any one of (11) to (16) above, in which the arranging step includes, in a case where a radius of the arrangement circle is larger than a predetermined length and the virtual speaker arranged on a circumference of the arrangement circle is posterior to any of the speakers, setting the radius of the arrangement circle to a radius of the predetermined length and resetting the virtual speaker arrangement.

(18)

The information processing method according to any one of (11) to (16) above, in which, the estimating step includes, in a case where the N speakers are located within a predetermined range in a front and back direction, estimating the user listening position by using position information of the standard speaker and position information of an average position in the front and back direction of the N speakers, and the arranging step includes setting a radius of the arrangement circle to the predetermined length.

(19)

A program that causes an information processing apparatus to perform:

processing of estimating a user listening position by using position information of N speakers that are three or more speakers; and processing of setting virtual speaker arrangement by using the user listening position.

REFERENCE SIGNS LIST

1 Information processing apparatus
3 Speaker
4 Virtual speaker
5 Remote controller
11, 31 CPU
11*a* Relative position recognition part
11*b* Channel setting part
11*c* Virtual speaker setting part
11*d* Channel signal processing part
12 Output signal forming part
110 Estimation part
111 Arrangement part
C1 Standard circle
C2 Enlarged circle
C3 Arrangement circle
C4 Reference circle
P1 Standard point
P2 Average position
P3 Movement point
R1 Radius
R2 Radius
R3 Reference radius
Ur User listening position

The invention claimed is:

1. An information processing apparatus, comprising:

an estimation part configured to:

recognize a standard speaker from a plurality of speakers, wherein the plurality of speakers includes at least three speakers;

recognize a farthermost speaker that is farthermost from a reference position among the plurality of speakers, wherein the reference position is associated with the standard speaker;

obtain a standard circle that passes through the standard speaker and the farthermost speaker;

move a center of the standard circle based on position information of the plurality of speakers; and estimate, as a user listening position, the center of the standard circle after the movement; and an arrangement part configured to set a virtual speaker arrangement based on the user listening position.

2. The information processing apparatus according to claim 1, wherein the arrangement part is further configured to:

set an arrangement circle centered on the user listening position; and set the virtual speaker arrangement to arrange a virtual speaker on a circumference of the arrangement circle.

3. The information processing apparatus according to claim 2, wherein the arrangement part is further configured to:

enlarge a radius of the standard circle by specific constant multiplication;

set the enlarged standard circle as the arrangement circle.

4. The information processing apparatus according to claim 1, wherein the estimation part is further configured to recognize a set of standard speakers, including the standard speaker, from the plurality of speakers, the set of standard speakers includes a front left speaker and a front right speaker, and the reference position is a midpoint between the front left speaker and the front right speaker.

5. The information processing apparatus according to claim 1, wherein the standard speaker is a front center speaker, and the reference position is a position of the front center speaker.

6. The information processing apparatus according to claim 1, wherein the estimation part is further configured to:

obtain an average position in at least a front direction and a back direction of the plurality of speakers based on the position information of the plurality of speaker; and move the center of the standard circle in the front direction and the back direction up to a position aligned with the average position in a left direction and a right direction of the plurality of speakers.

7. The information processing apparatus according to claim 2, wherein, the virtual speaker is posterior to at least one speaker of the plurality of speakers, the arrangement circle has a radius greater than a specific length, and the arrangement part is further configured to:

set the radius of the arrangement circle to the specific length based on:

the radius of the arrangement circle that is larger than the specific length, and the virtual speaker on the circumference of the arrangement circle that is posterior to the at least one speaker of the plurality of speakers; and reset the virtual speaker arrangement based on the set radius of the arrangement circle.

8. The information processing apparatus according to claim 2, wherein, the plurality of speakers is within a specific range in a front direction and a back direction of the plurality of speakers, the estimation part is further configured to estimate the user listening position based on:

the plurality of speakers that is within the specific range, position information of the standard speaker, and position information of an average position in the front direction and the back direction of the plurality of speakers, and the arrangement part is further configured to set a radius of the arrangement circle to a specific length.

9. An information processing method, comprising:

recognizing a standard speaker from a plurality of speakers, wherein the plurality of speakers includes at least three speakers;

recognizing a farthermost speaker that is farthermost from a reference position among the plurality of speakers, wherein the reference position is associated with the standard speaker;

obtaining a standard circle that passes through the standard speaker and the farthermost speaker;

moving a center of the standard circle based on position information of the plurality of speakers;

estimating, as a user listening position, the center of the standard circle after the movement; and setting a virtual speaker arrangement based on the user listening position.

10. The information processing method according to claim 9, further comprising:

setting an arrangement circle centered on the user listening position; and setting the virtual speaker arrangement to arrange a virtual speaker on a circumference of the arrangement circle.

11. The information processing method according to claim 10, further comprising:

enlarging a radius of the standard circle by specific constant multiplication; and setting the enlarged standard circle as the arrangement circle.

12. The information processing method according to claim 9, further comprising recognizing a set of standard speakers, including the standard speaker, from the plurality of speakers, wherein the set of standard speakers includes a front left speaker and a front right speaker, and the reference position is a midpoint between the front left speaker and the front right speaker.

13. The information processing method according to claim 9, wherein the standard speaker is a front center speaker, and the reference position is a position of the front center speaker.

14. The information processing method according to claim 9, further comprising:

obtaining an average position in at least a front direction and a back direction of the plurality of speakers based on the position information of the plurality of speakers; and moving the center of the standard circle in the front direction and the back direction up to a position aligned with the average position in a left direction and a right direction of the plurality of speakers.

15. The information processing method according to claim 10, further comprising:

setting a radius of the arrangement circle to a specific length based on:

the radius of the arrangement circle that is larger than the specific length, and the virtual speaker on the circumference of the arrangement circle that is posterior to at least one speaker of the plurality of speakers; and resetting the virtual speaker arrangement based on the set radius of the arrangement circle.

16. The information processing method according to claim 10, further comprising:

estimating the user listening position based on:

the plurality of speakers being within a specific range in a front direction and a back direction of the plurality of speakers, position information of the standard speaker, and position information of an average position in the front direction and the back direction of the plurality of speakers; and setting a radius of the arrangement circle to a specific length.

17. A non-transitory computer-readable medium having stored thereon, computer-executable instructions which, when executed by a processor of an information processing device, cause the processor to execute operations, the operations comprising:

recognizing a standard speaker from a plurality of speakers, wherein the plurality of speakers includes at least three speakers;

recognizing a farthermost speaker that is farthermost from a reference position among the plurality of speakers, wherein the reference position is associated with the standard speaker;

obtaining a standard circle that passes through the standard speaker and the farthermost speaker;

moving a center of the standard circle based on position information of the plurality of speakers;

estimating, as a user listening position, the center of the standard circle after the movement; and setting virtual speaker arrangement based on the user listening position.

18. An information processing apparatus, comprising:

an estimation part configured to estimate a user listening position based on position information of a plurality of speakers, wherein the plurality of speakers includes at least three speakers; and an arrangement part configured to:

set an arrangement circle based on the estimation of the user listening position, wherein a center of the arrangement circle corresponds to the user listening position;

set a virtual speaker arrangement to arrange a virtual speaker on a circumference of the arrangement circle, wherein the virtual speaker is posterior to at least one speaker of the plurality of speakers;

set a radius of the arrangement circle to a specific length based on:

the radius of the arrangement circle that is larger than the specific length, and the virtual speaker on the circumference of the arrangement circle that is posterior to the at least one speaker of the plurality of speakers; and reset the virtual speaker arrangement based on the set radius of the arrangement circle.

* * * * *